US011441340B2

(12) United States Patent
Rhein et al.

(10) Patent No.: US 11,441,340 B2
(45) Date of Patent: Sep. 13, 2022

(54) DOOR HANDLE ASSEMBLY FOR A VEHICLE DOOR

(71) Applicant: Huf Hülsbeck & Fürst GmbH & Co. KG, Velbert (DE)

(72) Inventors: Michael Rhein, Mönchengladback (DE); Bernd Reifenberg, Essen (DE); Jan Heyduck, Sindelfingen (DE); Jürgen Jooss, Böblingen (DE); Martin Lindmayer, Sulz (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 519 days.

(21) Appl. No.: 16/479,690

(22) PCT Filed: Dec. 13, 2017

(86) PCT No.: PCT/EP2017/082537
§ 371 (c)(1),
(2) Date: Jul. 22, 2019

(87) PCT Pub. No.: WO2018/137839
PCT Pub. Date: Aug. 2, 2018

(65) Prior Publication Data

US 2021/0404227 A1 Dec. 30, 2021

(30) Foreign Application Priority Data

Jan. 25, 2017 (DE) ..... 10 2017 101 417.9

(51) Int. Cl.
*E05B 85/10* (2014.01)
*E05B 81/16* (2014.01)
(Continued)

(52) U.S. Cl.
CPC ..... *E05B 85/107* (2013.01); *E05B 81/16* (2013.01); *E05B 81/42* (2013.01); *E05B 81/76* (2013.01); *E05B 81/90* (2013.01)

(58) Field of Classification Search
CPC ..... E05B 81/16; E05B 81/42; E05B 81/76; E05B 81/90; E05B 81/64; E05B 5/00;
(Continued)

(56) References Cited

U.S. PATENT DOCUMENTS 6,698,262 B2 * 3/2004 Wittwer ..... E05B 85/107 70/208
8,701,353 B2 * 4/2014 Patel ..... E05B 85/103 49/503
(Continued)

FOREIGN PATENT DOCUMENTS

DE 202014010524 U1 * 2/2016 ..... E05B 81/76
DE 102014113495 A1 * 3/2016 ..... E05B 81/90
(Continued)

OTHER PUBLICATIONS

European Patent Office, International Search Report and Written Opinion for PCT Application No. PCT/EP2017/082537, dated Feb. 15, 2018.

*Primary Examiner* — Kristina R Fulton
*Assistant Examiner* — Emily G. Brown
(74) *Attorney, Agent, or Firm* — Honigman LLP; Matthew H. Szalach; David J. Thomas

(57) ABSTRACT

A door handle assembly for a vehicle door includes a handle which is to be actuated by an operator, a lever element which supports the handle on a handle housing, and a motor-driven actuating element. The handle is designed to be movable out of an actuation position into a servo-opening position by being actuated by an operator. A detection means is formed on the handle housing in order to detect a movement of the handle out of the actuation position into the servo-opening
(Continued)

position so as to produce a movement of the motor-driven actuating element out of the handle extended position into a door opening position. Upon being moved out of the handle extended position into the door opening position, the motor-driven actuating element moves a vehicle door opening lever out of a ready position into an unlocked position, in which the vehicle door can be opened.

11 Claims, 13 Drawing Sheets

(51) Int. Cl.
*E05B 81/42* (2014.01)
*E05B 81/76* (2014.01)
*E05B 81/90* (2014.01)

(58) Field of Classification Search
CPC ..... E05B 5/006; E05B 5/003; E05B 85/103; E05B 85/107; Y10T 292/57; Y10S 292/31
See application file for complete search history.

(56) References Cited

U.S. PATENT DOCUMENTS

| | | | | |
|---|---|---|---|---|
| 10,760,307 | B2 * | 9/2020 | Rocci | E05B 81/76 |
| 2005/0121924 | A1 * | 6/2005 | Chanya | E05B 85/107 292/336.3 |
| 2013/0241215 | A1 * | 9/2013 | Halliwell | E05B 85/107 292/336.3 |

FOREIGN PATENT DOCUMENTS

| | | | |
|---|---|---|---|
| EP | 2730730 | A2 | 5/2014 |
| WO | WO-2016200743 | A1 | 12/2016 |

* cited by examiner

DOOR HANDLE ASSEMBLY FOR A VEHICLE DOOR

CROSS REFERENCE TO RELATED APPLICATIONS

This application claims priority under 35 U.S.C. § 371 to Patent Cooperation Treaty Application No. PCT/EP2017/082537, filed Dec. 13, 2017, which claims priority to DE Application No. 102017101417.9, filed Jan. 25, 2017, the contents of which are incorporated herein by reference in their entirety.

FIELD

The invention is directed to a door handle assembly for a vehicle door, wherein the door handle assembly has a handle for actuation by an operator proceeding flush with strake with an outer contour of the vehicle door in a non-use position and a handle housing attachable to the vehicle door, wherein the handle is mounted on the handle housing via a lever element.

BACKGROUND

This section provides background information related to the present disclosure and is not necessarily prior art.

Door handle assemblies, in which the handle in its non-use position proceeds flush with strake with the outer contour of the vehicle door, are known from the prior art. Thereby, with such door handle assemblies for a vehicle door of a motor vehicle, the handle can be designed as an inner or outer handle, wherein the present invention relates to a door handle assembly for an outer handle. A plurality of different constructions and embodiments exist for such door handle assemblies. The execution of a door handle assembly according to the invention refers to those constructions in which the handle housing is attached on the rear side of the vehicle door, that is, internally of the motor vehicle. The handle attached to the handle housing in such embodiments usually projects from the vehicle door and disturbs both the aesthetic impression of the vehicle and the vehicle aerodynamics. In order to avoid these disadvantages, prior art door handle assemblies are known, in which the outside of the handle in its non-use position, that is, in which it is not used, proceeds approximately flush to the outer contour of the vehicle door, thus flush with strake. Such a handle can be transferred into an actuation position to open the vehicle door or a lock on the vehicle side, in which position the handle protrudes with respect to the outer contour of the vehicle door. The handle is thereby extended by a motor when a legitimate operator approaches the vehicle. Once the handle is no longer needed, it drives back to the non-use position and thus disappears into the body, so as not to create air resistance.

With such known door handle assemblies, the unlocking of the vehicle door also takes place motor-operated, as soon as the operator actuates the handle in its actuation position.

When the actuation is detected by the operator, a drive motor is activated, in order to, for example, actuate a Bowden cable system, so that the vehicle door is unlocked and can be opened. However, the known door handle assemblies have the disadvantage that a drive motor for the movement of the handle from the non-actuation position into the actuation position a further, and a separate drive motor for the actuation of the Bowden cable system are required, whereby the production of door handle assembly is elaborate and therefore cost-intensive and the two drive motors let the door handle assembly become more susceptible to failure.

The invention is based on the object to provide a solution that provides a door handle assembly in a structurally simple manner, which is cost-effective in its manufacture and in which the susceptibility to failure is reduced.

SUMMARY

This section provides a general summary of the disclosure, and is not a comprehensive disclosure of its full scope or all of its features.

One aspect of the disclosure provides a door handle assembly for a vehicle door.

The door handle assembly for a vehicle door according to the invention comprises a handle for actuation by an operator proceeding flush with strake with an outer contour of the vehicle door in a non-use position, a handle housing attachable to the vehicle door, a lever member mounting the handle on the handle housing, of which a first lever end is rotatably attached to a lever rotation axis mounted on the handle housing and of which a second lever end is motion-coupled with the handle, and a motor-driven actuator and motion-coupled with the lever element, which is mounted movably on the handle housing between a rest position into a door opening position via a handle extension position.

In a normal operation of the door handle assembly, the motor-driven actuator, during its movement out of the rest position, in which the handle is arranged in the non-use position, into the handle extension position, moves the handle into an actuation position, in which the handle protrudes from the outer contour of the vehicle door. Furthermore, the handle is formed to be movable from the actuating position into a servo opening position by means of actuation by an operator. A detection means is arranged on the handle housing, which upon detection of a movement of the handle from the actuation position into the servo opening position, is formed effecting a movement of the motor-driven actuator from the handle extension position into a door opening position. The motor-driven actuator is thereby motion-coupled with a vehicle door opening lever mounted on the handle housing between a standby position and an unlocking position. The motor-driven actuator moves, during its movement from the handle extension position to the door opening position, the door opening lever from the standby position into the unlocking position, in which the vehicle door can be opened.

Advantageous and expedient designs and further developments of the invention will become apparent from the dependent claims.

By means of the invention, a door handle assembly for a vehicle is provided, which is characterized by a functional design and which has a cost-effective structure. According to the invention, a single and motor-driven actuator ensures that both the handle is moved from its non-use position into its actuating position and the vehicle door release lever is moved into its unlocking position. Consequently, only a single drive motor is needed to drive the actuator, whereby the above-mentioned actions of the handle extension and the vehicle door unlocking are effected. The inventive consideration of a single drive motor in contrast to two drive motors, as known from the prior art, further has the advantage that the installation space of the entire door handle assembly can be executed smaller and more compact.

For a compact installation space of the door handle assembly, the invention provides in a design that the motor-driven actuator is rotatably mounted on the handle housing via a motor drive shaft and that the movement of the motor-driven actuator from the rest position into the door opening position via the handle extension position is a rotary movement about the motor drive shaft.

To achieve a desired movement, the invention provides in a further design, that the motor-driven actuator is disk-shaped with a non-uniform edge which cooperates, with a rotary movement of the actuator about the motor drive shaft from the rest position into the handle extension position, with a lever element formed on the lever lug. The actuator thus acts on the handle via the lever lug and the lever and consequently moves the handle. The actuator is thereby formed in the manner of a cam disk, whereby a more cost-effective production and a simple and reliable construction can be realized.

So that different movements can be achieved with the aid of the actuator, it is provided in a design of the invention, that the non-uniform edge has a first edge portion with a radius increasing from a minimum radius to a maximum radius and a second edge portion with the maximum radius, wherein the maximum radius is formed larger than the minimum radius. Both the minimum radius and the maximum radius each have a constant radius with respect to the motor drive shaft, on which the actuator is mounted in its center and with which the actuator rotates together, when the motor drive shaft is rotated uniformly and evenly by a drive motor.

In order for the handle to be moved from its flush with strake position to a position in which it can be operated by an operator, it is provided in a design of the invention that, with a uniform handle extension rotary movement of the motor-driven actuator from the non-use position to the handle extension position, the first edge portion with increasing radius presses against the lever lug of the lever element and moves the handle from the non-use position to the actuation position via the lever element. If a legitimized operator is thus detected by a system provided for this and known from the prior art, a drive motor is activated, which then rotates the motor drive shaft and thereby the actuator.

According to the invention, it is then further provided that the uniform handle extension rotary movement of the motor-driven actuator stops at the latest when the second edge portion of the motor-driven actuator abuts the lever lug of the lever element. The increasing radius thus presses against the lever lug, whereby the lever element rotates about the lever rotation axis and extends the handle from the outer contour from the flush with strake position. As the second edge portion has a constant radius and thereby represents a neutral radius, through which the lever lug is not moved any further, a wide angle range can be specified for the necessary rotary movement of the actuator. After reaching the predetermined rotation, the drive motor then stops, so that the actuator stops in any case, when the second edge portion abuts the lever lug and the handle is thereby arranged in the actuation position.

In a further design of the invention it is provided that the non-uniform edge has a third edge portion with the minimum radius, wherein the transition from the second edge portion to the third edge portion is formed abruptly. The third edge portion also has a constant radius. According to the invention, the lever lug of the lever element abuts the third edge portion when the handle is arranged in the non-use position and the motor-driven actuator is arranged in the rest position. The abruptly formed transition from the second edge portion to the third edge portion thereby forms a kind of protection for the lever element, because the abruptly formed transition blocks a corresponding movement of the lever element.

It is particularly advantageous in a further development of the invention if an unlocking contour is formed on the upper side or bottom side of the disk-shaped and motor-driven actuator, which cooperates with the vehicle door opening lever during a movement of the actuator from the handle extension position into the door opening position. In this manner, the actuator can be used not only for extending the handle, but also for unlocking the vehicle door.

For this purpose, the invention provides in its design that the unlocking contour has a first contour portion with a constant neutral radius, a second contour portion with a progression radius and a third contour portion with a constant radius, wherein the constant radius is greater than the neutral radius, wherein the constant radius and the neutral radius each have a constant radius, and wherein the progression radius is a radius increasing from the neutral radius to the constant radius. The unlocking contour formed on the actuator is axially offset to the non-uniform edge with respect to the motor drive shaft, in order to be able to cooperate with the vehicle door opening lever.

The invention provides in a further design, that, with a rotary movement of the motor-driven actuator from the rest position to the handle extension position, the first contour portion with neutral radius moves tangentially past a longitudinal end of the vehicle door opening lever. During this movement, consequently, the unlocking contour does not affect the door opening lever, which is also not desired when extending the handle from its flush with strake position into its actuation position.

A cooperation is only desired when the handle is actuated by an operator. For this purpose, the invention provides in a further design, that, in a door unlocking rotary movement of the motor-driven actuator from the handle extension position into the door opening position, the second contour portion and then the third contour portion presses against the first longitudinal end of the vehicle door opening lever and urges the vehicle door opening lever from its standby position into its unlocking position for opening the vehicle door.

As the vehicle door opening lever is coupled with a Bowden cable system (wherein a coupling rod or other connections for unlocking a lock device are also conceivable), the adjustment of the door opening lever effects an unlocking or an opening of an associated door lock, so that the vehicle door can be swung open, when the operator pulls on the handle. The rotary movement of the actuator is also specified for the necessary rotation of the unlocking contour about the motor drive shaft, wherein it is advantageous if the door unlocking rotary movement stops at the latest when the second edge portion of the motor-driven actuator abuts the lever lug of the lever element. Due to the fact that the second edge portion is formed with a constant radius, the unlocking contour does not have to be rotated about an exact angle, as a further rotation along the second edge portion does not effect a further movement of the of the door opening lever, which is already arranged in the unlocking position. Consequently, by means of the constant radius of the second edge portion, greater tolerances with regard to the rotation angle of the actuator are possible, which also applies to all other edge portions of the actuator.

In one design of the invention, it is provided that the constant radius of the unlocking contour is formed smaller than the maximum radius of the non-uniform edge of the motor-driven actuator. It is thereby ensured that malfunctions are recognized, if, for example, the actuator should sit obliquely on the motor drive shaft and thereby either the non-uniform edge affects the vehicle door opening lever or the unlocking contour affects the lever lug.

The actuator has, as a one-piece component, the non-uniform edge and the unlocking contour. However, it is also conceivable that two separate components are used for moving the handle and the vehicle opening lever, but which are mounted on the common motor rotary axis, so that a single motor can continue and inventively be used in the door handle assembly. The invention provides for this that a cam disk is rotatably supported on the handle housing in addition to and separately from the motor-driven actuator via the motor drive shaft, the cam disc cooperating with the vehicle door opening lever, in order to move the vehicle door opening lever from the standby position into the unlocking position.

Finally, the detection means may be a Hall sensor, whereby a movement of the handle from the actuation position into the servo opening position can be easily detected or captured to send a corresponding signal to a drive motor, which then moves the actuator from its handle extension position into the door opening position, whereby the vehicle door opening lever is moved from the standby position into the unlocking position, in which the vehicle door can be opened. However, other sensors or detection means are also conceivable in order to detect a movement of the handle and to activate a drive motor for moving the actuator.

It is understood that the characteristics mentioned above and those yet to be explained can be used not only in the combination given, but also in other combinations or alone without departing from the scope of the present invention. The scope of the invention is defined only by the claims.

Further details, characteristics and advantages of the object of the invention will become apparent from the following description in conjunction with the drawing, in which a preferred embodiment of the invention is shown by way of example.

DRAWINGS

The drawings described herein are for illustrative purposes only of selected configurations and not all possible implementations, and are not intended to limit the scope of the present disclosure.

The figures show:

Figure 10:
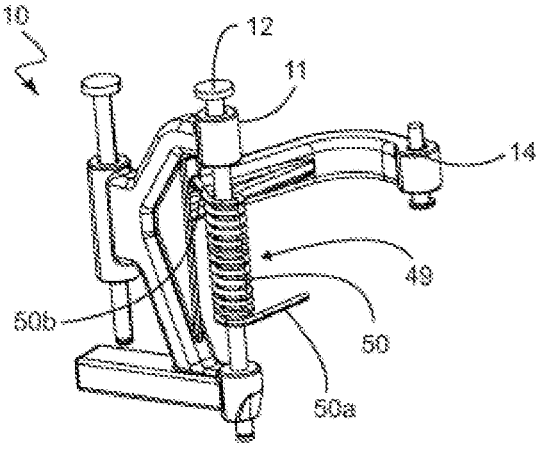
FIG. 10 illustrates a perspective view of a lever system of the lever system shown in FIG. 8.
Figure 11:
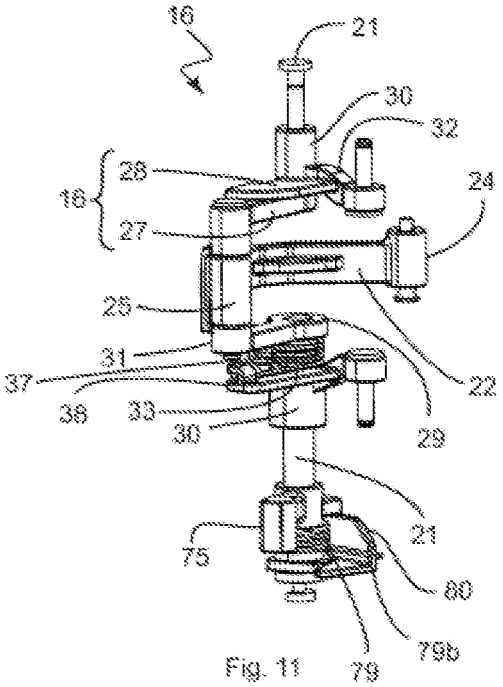
FIG. 11 illustrates a first perspective view of a lever mechanism of the lever system shown in FIG. 8.
Figure 19A:
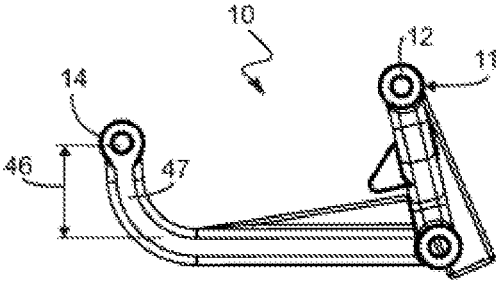
Figure 19B:
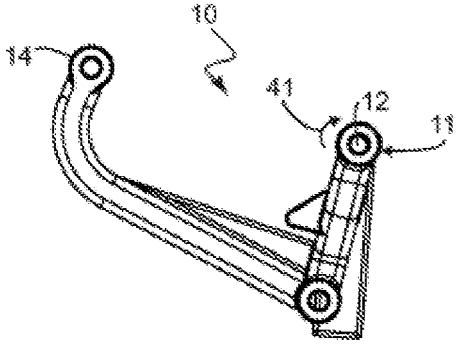
Figure 20A:
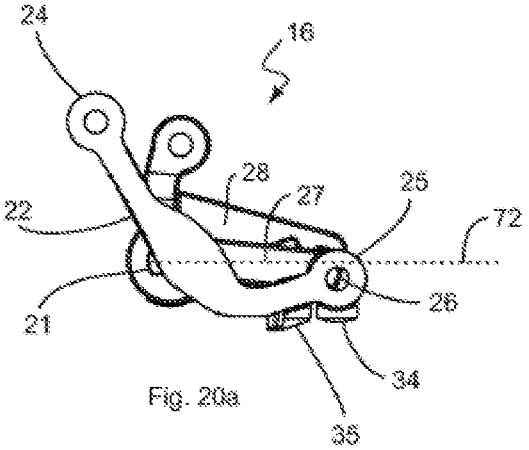
Figure 20B:
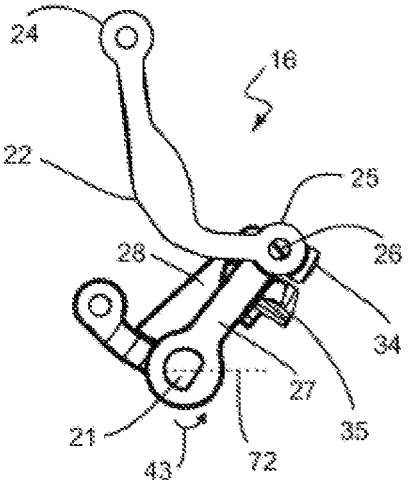
Figure 20C:
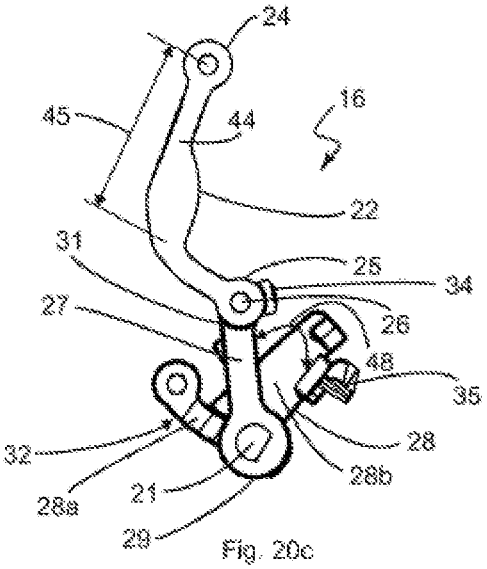
Figure 21:
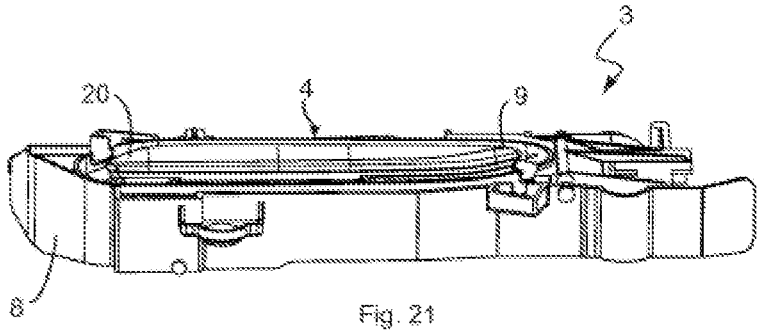
Figure 22:
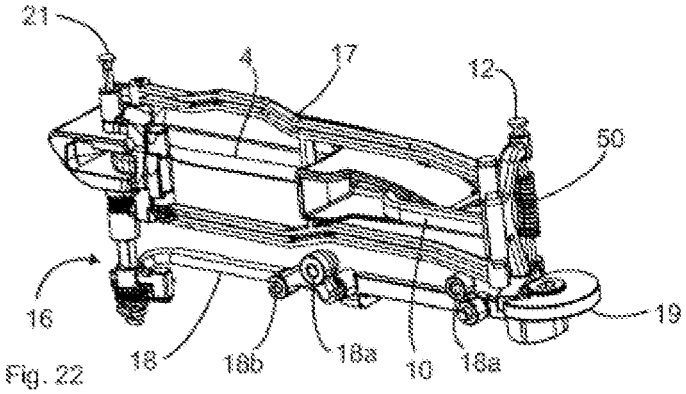
Figure 23:
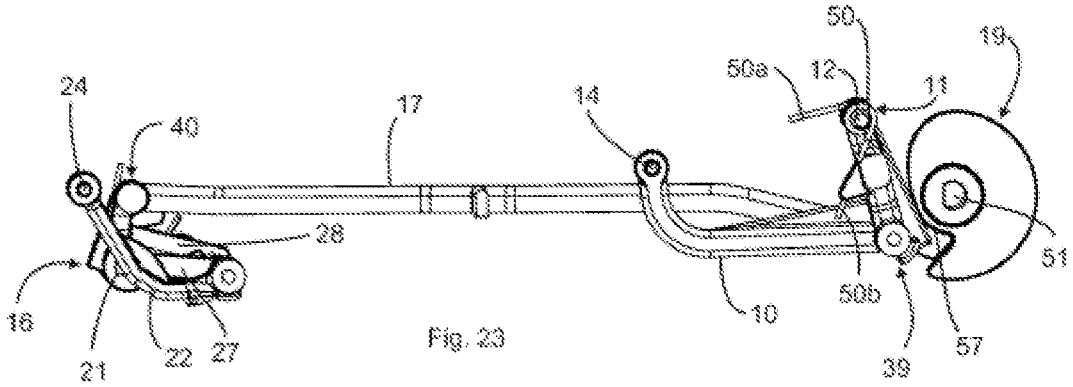
Figure 24:
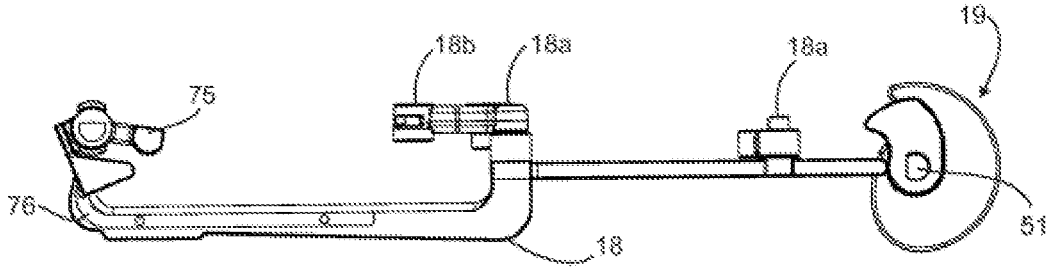
Figure 25:
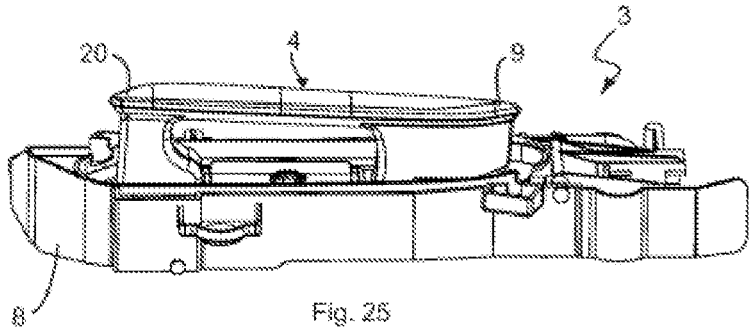
Figure 26:
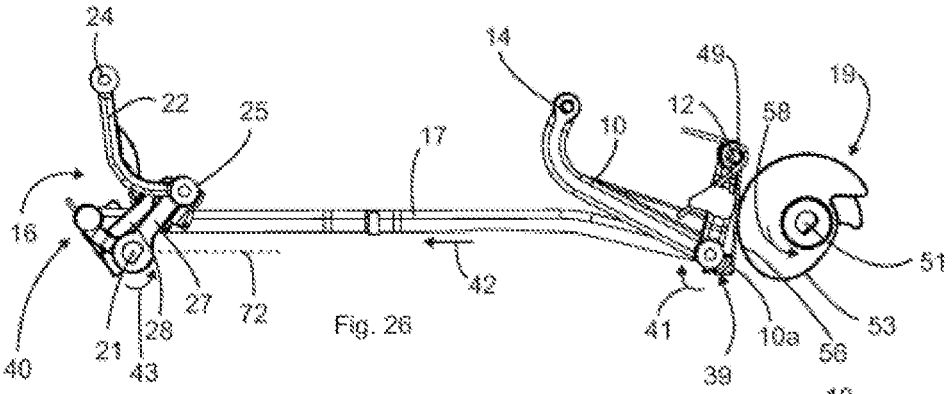
Figure 27:
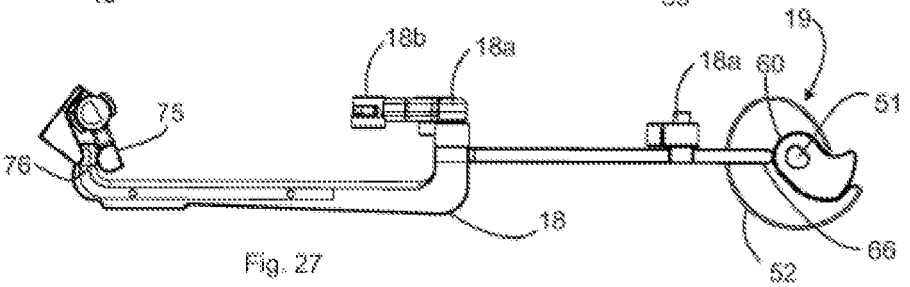
Figure 28:
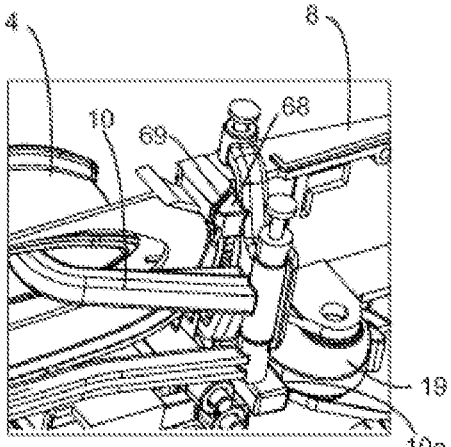
Figure 29:
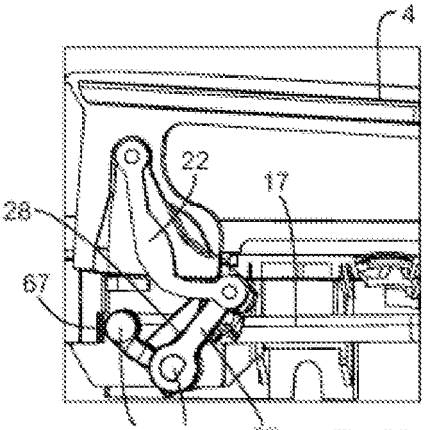
Figure 30:
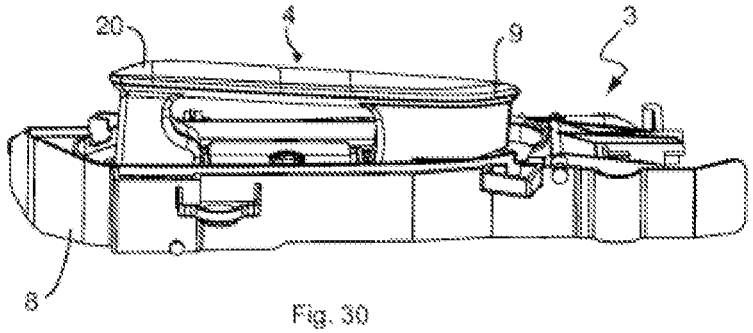
Figure 31:
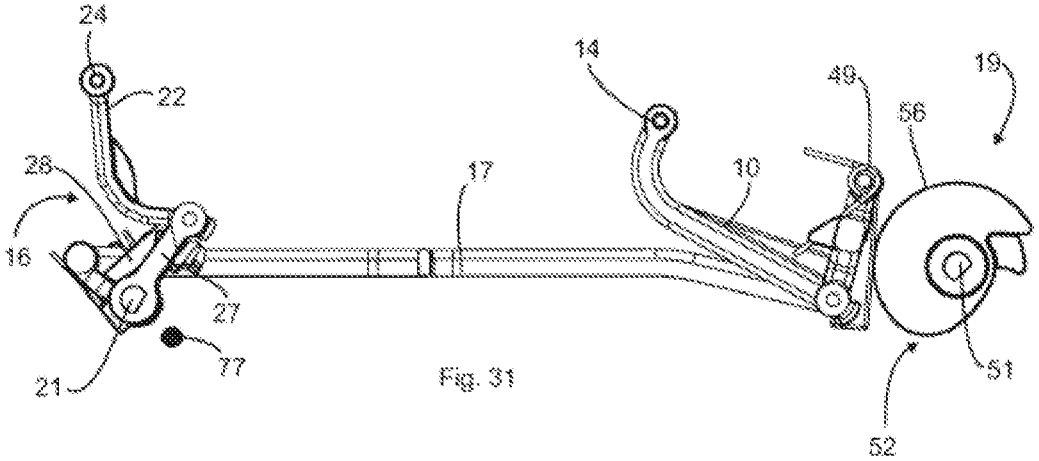
Figure 32:
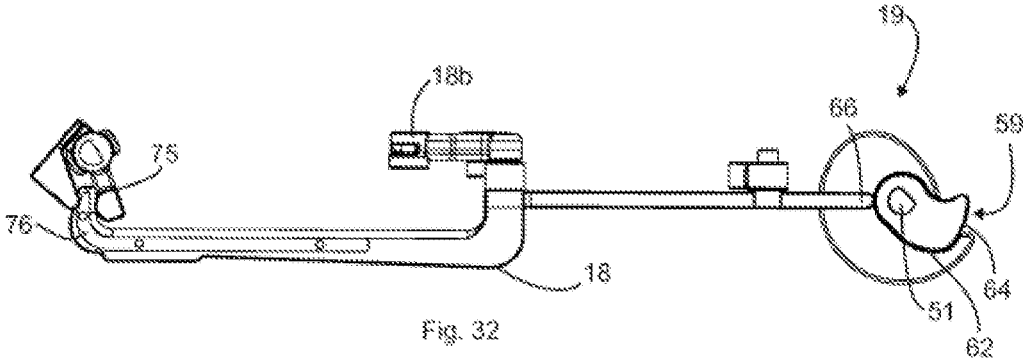
Figure 33:
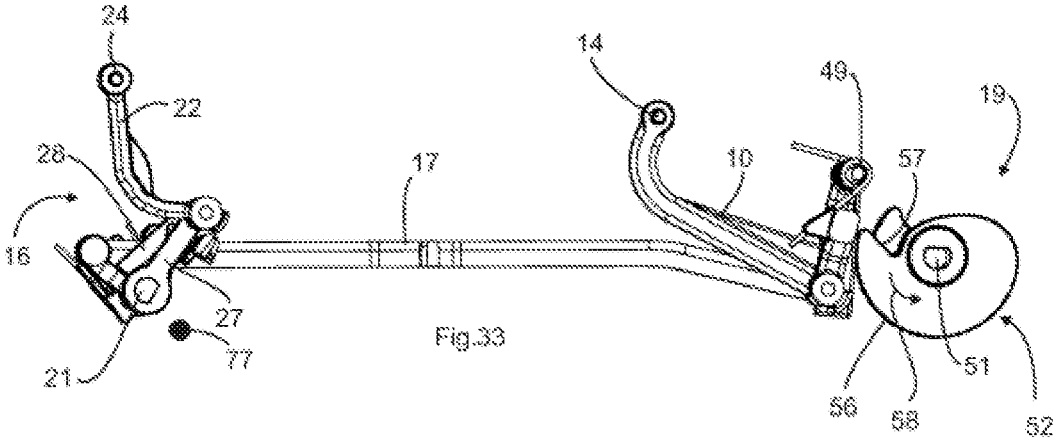
Figure 34:
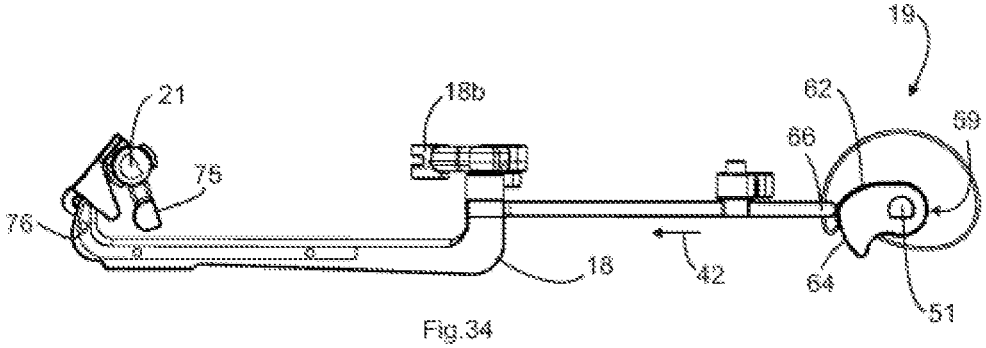
Figure 35:
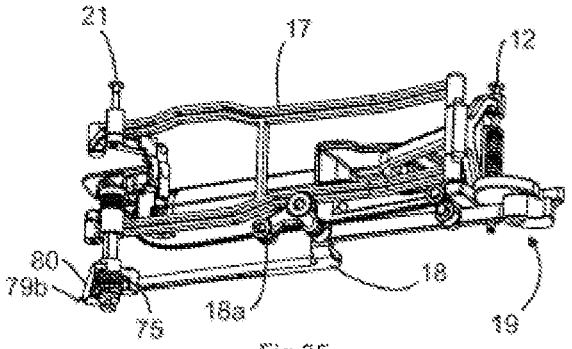
Figure 36:
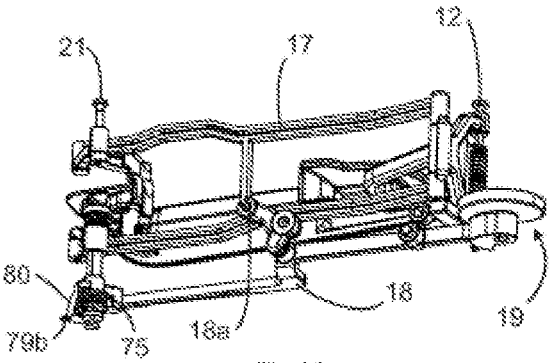
Figure 37:
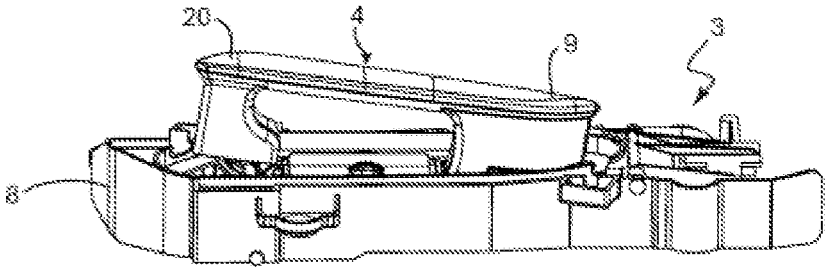
Figure 38:
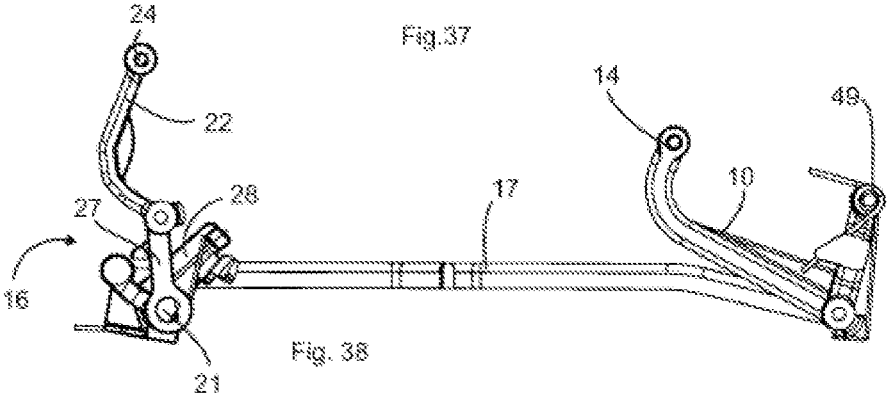
Figure 39:
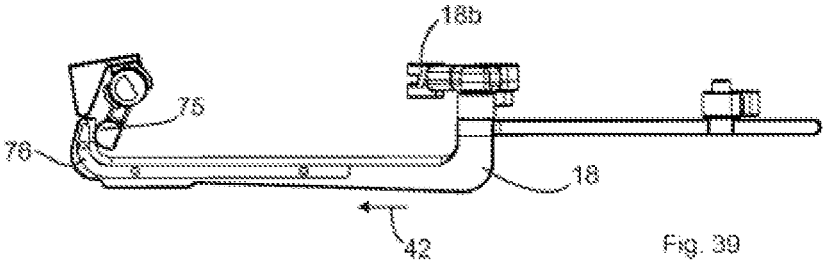
Figure 40:
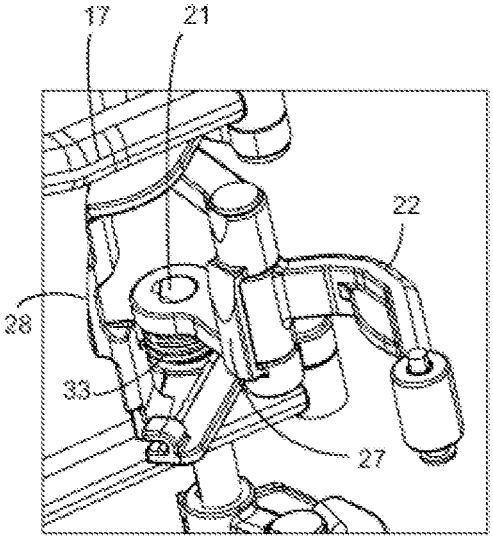
Figure 41:
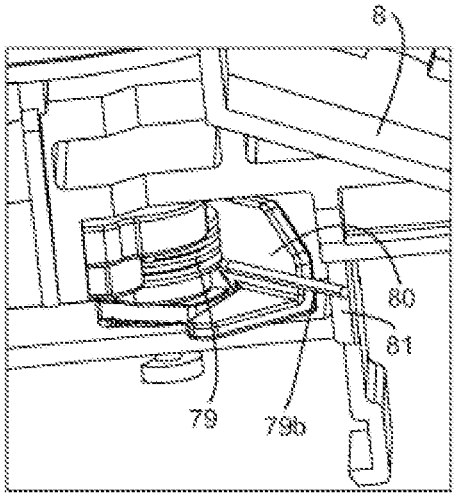
Figure 42:
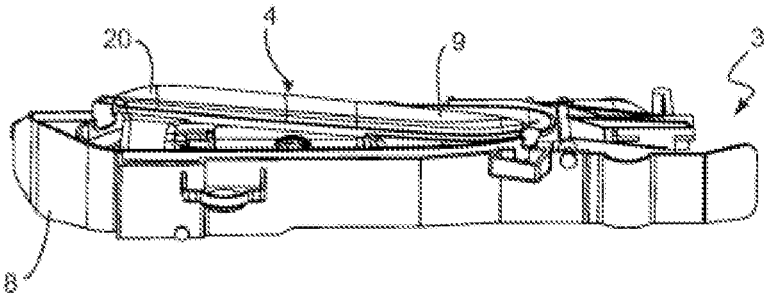
Figure 43:
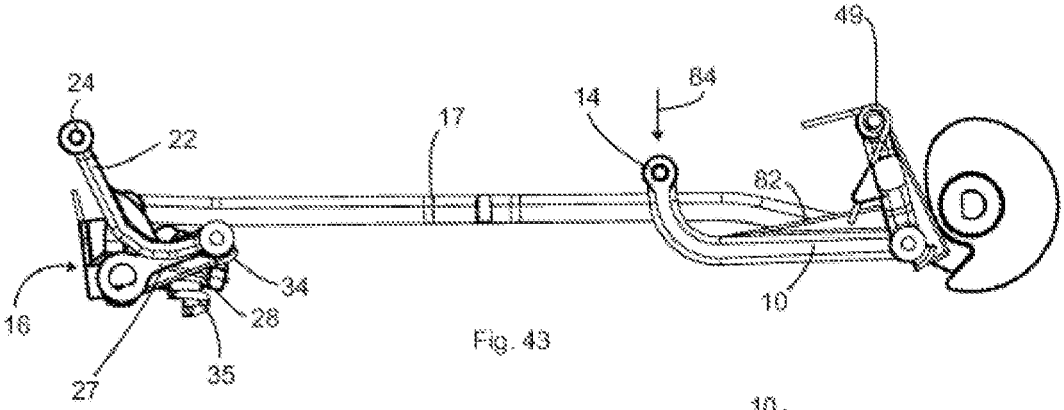
Figure 44:
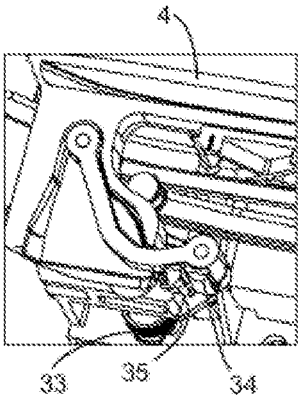
Figure 46:
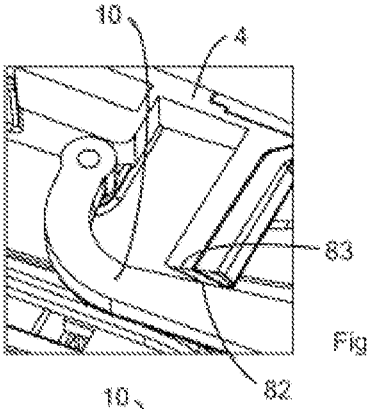
Figure 45:
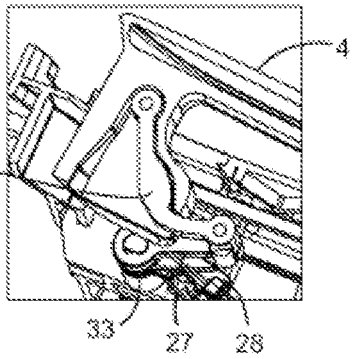
Figure 47:
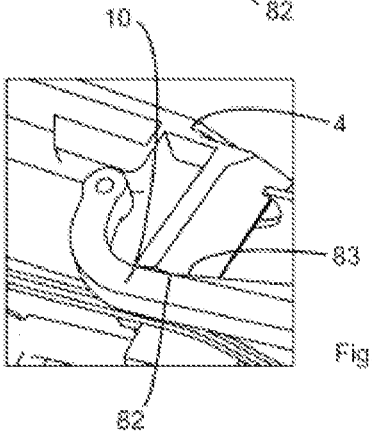

FIG. 19*a* illustrates a plan view of the lever element of FIG. 10, when the handle is arranged in the non-use position;

FIG. 19*b* illustrates a plan view of the lever element, when the handle is arranged in the operating position;

FIG. 20*a* illustrates a plan view of the lever mechanism of FIG. 11, when the handle is arranged in a non-use position;

FIG. 20*b* illustrates a plan view of the lever mechanism, when the handle is arranged in an operating position;

FIG. 20*c* illustrates a plan view of the lever mechanism, when an operator pulls the handle for opening the vehicle door;

FIG. 21 illustrates a side view of the door handle assembly according to the invention, when the handle is arranged in the non-use position;

FIG. 22 illustrates a perspective view of the lever system and a vehicle door opening lever, when the handle is arranged in a non-use position;

FIG. 23 illustrates a plan view of the lever system, when the handle is arranged in the non-use position;

FIG. 24 illustrates a bottom view of the lever system, when the handle is arranged in the non-use position;

FIG. 25 illustrates a side view of the door handle assembly according to the invention, when the handle is arranged in the operating position;

FIG. 26 illustrates a plan view of the lever system, when the handle is arranged in the operating position;

FIG. 27 illustrates a bottom view of the lever mechanism, when the handle is arranged in the operating position;

FIG. 28 illustrates a detailed view of the lever element, when the handle is arranged in the operating position;

FIG. 29 illustrates a detailed view of the lever mechanism, when the handle is arranged in the operating position;

FIG. 30 illustrates a side view of the door handle assembly according to the invention, when the handle is arranged in a servo opening position;

FIG. 31 illustrates a plan view of the lever system, when the handle is arranged in the servo opening position;

FIG. 32 illustrates a bottom view of the lever system, when the handle is arranged in the servo opening position;

FIG. 33 illustrates a plan view of the lever system, when, due to the positioning of the handle in the servo opening position, the actuator is moved in an arranged manner;

FIG. 34 illustrates a bottom view of the lever system, when, due to the positioning of the handle in the servo opening position, the actuator is moved in an arranged manner;

FIG. 35 illustrates a perspective side view of the lever system, when the handle is arranged in the servo opening position;

FIG. 36 illustrates a perspective side view of the lever system, when, due to the positioning of the handle in the servo opening position, the actuator is moved in an arranged manner;

FIG. 37 illustrates a side view of the door handle assembly according to the invention, when the handle is arranged in an opening position or emergency operating position;

FIG. 38 illustrates a plan view of the lever system, when the handle is arranged in the opening position or emergency operating position;

FIG. 39 illustrates a bottom view of the lever mechanism, when the handle is arranged in the opening position or emergency operating position;

FIG. 40 illustrates a detailed view of the lever mechanism, when the handle is arranged in the opening position or emergency operating position;

FIG. 41 illustrates a further detailed view of the lever mechanism, when the handle is arranged in the opening position or emergency operating position;

FIG. 42 illustrates a side view of the door handle assembly according to the invention, when the handle is arranged in an emergency operating position;

FIG. 43 illustrates a plan view of the lever system, when the handle is arranged in the emergency handling position;

FIG. 44 illustrates a detailed view of the lever mechanism, when the handle is arranged in the non-use position;

FIG. 45 illustrates a further detailed view of the lever mechanism, when the handle is arranged in the emergency handling position;

FIG. 46 illustrates a detailed view of the lever element, when the handle is arranged in the non-use position;

FIG. 47 illustrates a further detailed view of the lever element, when the handle is arranged in the emergency handling position.

Figure 1:
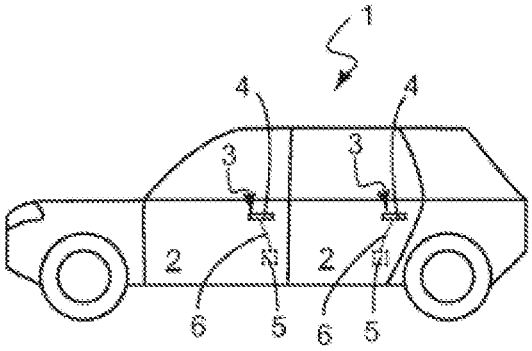
FIG. 1 illustrates a schematically illustrated motor vehicle with an exemplary indicated door handle assembly according to the invention.

In FIG. 1, a vehicle or motor vehicle 1 in the form of a passenger car is shown in an exemplary manner, which in the example has four vehicle doors 2 (two of which are visible in FIG. 1), which have a door handle assembly 3 and can be opened in particular with the aid of a door handle or a handle 4. The vehicle doors 2 are firmly closed by means of a respective door lock 5, which is designed in the manner of a rotary latch lock, and can be opened or unlocked from the outside only via a respective movement of the handle 4. This movement on the handle 4 consists of a pulling movement, wherein the corresponding movement of the handle 4 is transmitted via a Bowden cable system 6 to the corresponding lock 5. By the corresponding movement of the handle 4, the associated vehicle door 2 can then be opened, wherein, in the case of a current-operated normal operation, a slight pulling movement is sufficient so that the Bowden cable system 6 is electrically operated to unlock the door lock 5. In case of a currentless emergency operation, the door handle assembly 3 according to the invention is formed in such a manner that a manual unlocking of the door lock 5 and thereby a manual opening of the vehicle door is possible by means of an actuation of the handle 4 effected by a user.

Figure 2:
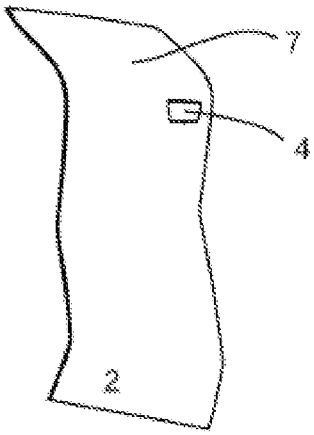
FIG. 2 illustrates a perspective illustration of a vehicle door with a handle of the door handle assembly arranged flush with strake.

FIG. 2 shows a perspective view of one of the vehicle doors 2 and the handle 4 serving to open the vehicle door 2. In FIG. 2, the handle 4—when installing the door handle assembly 3 in the vehicle door 2—is arranged approximately flush with the outer contour 7 of the vehicle door 2, that is, flush with strake.

In this position, the handle 4 is in a non-use position in which it is not needed. From the non-use position shown in FIG. 2, the handle 4 can be moved into an actuating position, in which it projects beyond the outer contour 7 of the vehicle door 2. Accordingly, the handle 4 is arranged protruding from the vehicle door 2 in its actuation position. In this protruding or from the outer contour 7 extended actuation position, an operator can grip behind the handle 4 and actuate or handle to open the vehicle door 2 or to unlock the door lock 5 on the vehicle side. According to the present invention, the transfer of the handle 4 from the non-use position to the actuation position can take place either in a current-driven normal operation by means of a suitable drive means or in a currentless emergency operation by means of manual actuation by the operator, which will be discussed in more detail below. Proximity sensors or other sensors can be provided for the current-driven normal operation, in order to bring the handle 4 out of the flush with strake or flat flush non-use position into the actuation position, as soon as an operator approaches the door handle assembly 3 or the handle 4.

Figure 3:
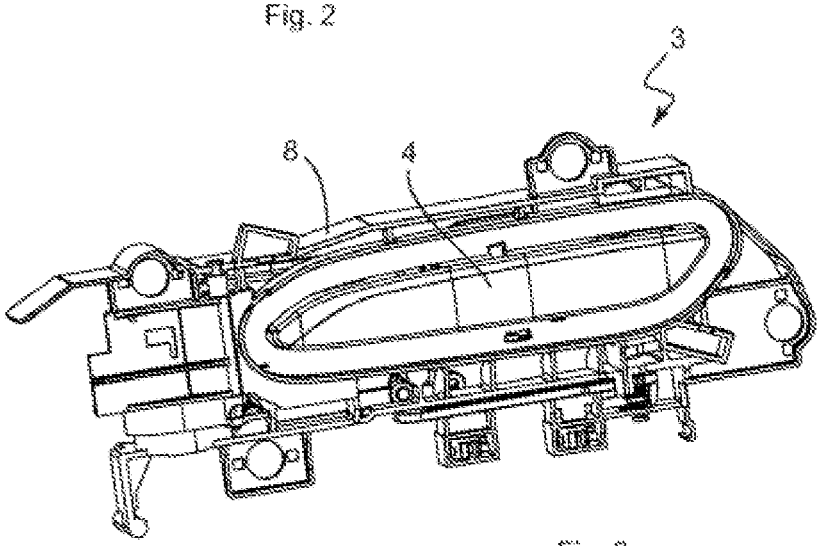
FIG. 3 illustrates a perspective front view of the door handle assembly according to the invention.
Figure 4:
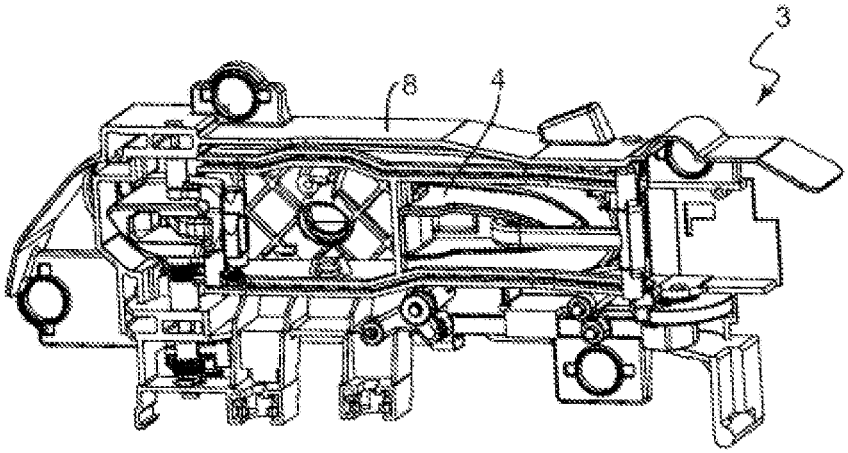
FIG. 4 illustrates a perspective rear view of the door handle assembly shown in FIG. 3.
Figure 5:
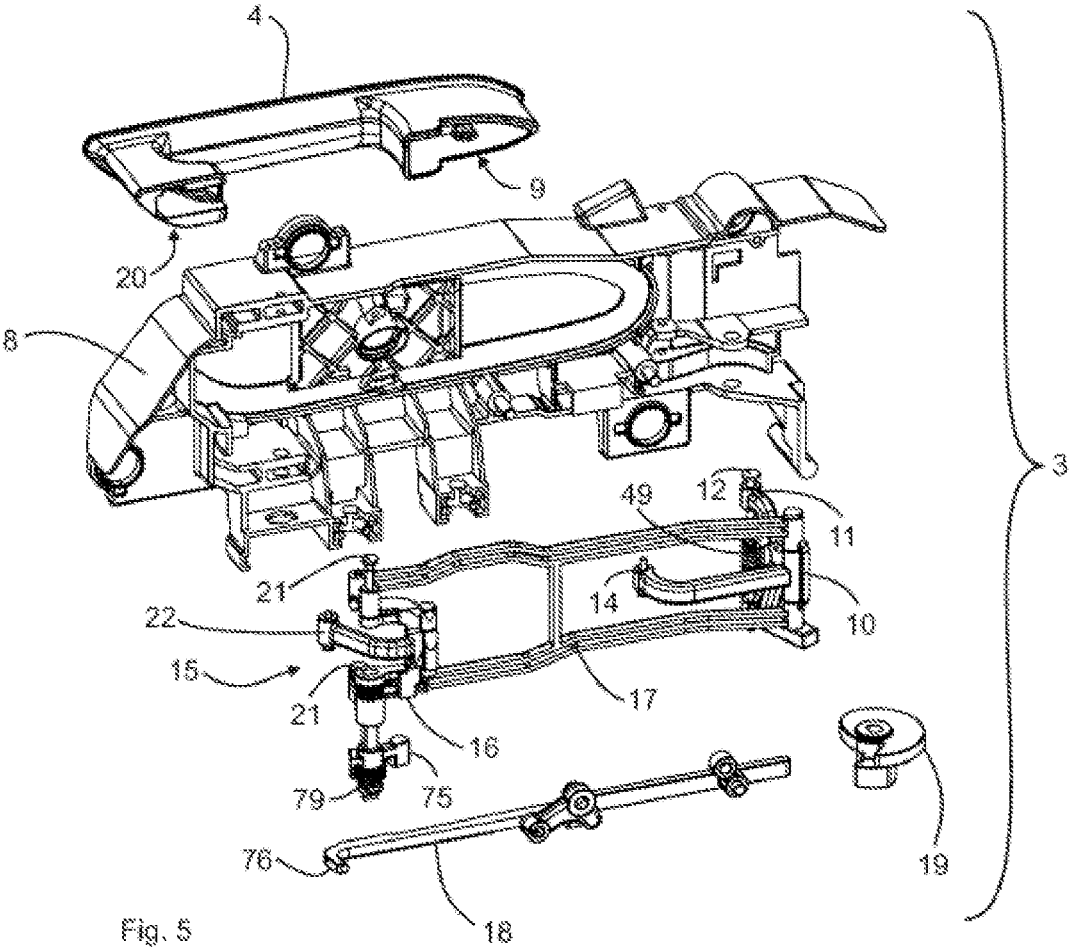
FIG. 5 illustrates a perspective single part illustration of the door handle assembly shown in FIGS. 3 and 4.
Figure 6:
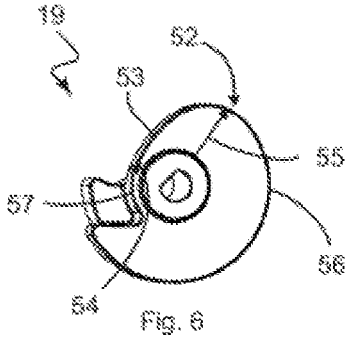
FIG. 6 illustrates a plan view of an actuator of the door handle assembly.
Figure 7:
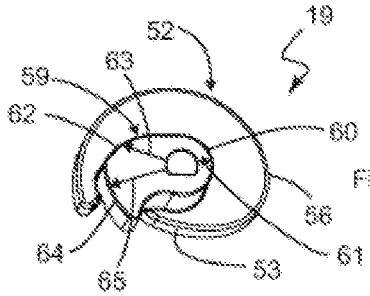
FIG. 7 illustrates a bottom view of the actuator of the door handle assembly shown in FIG. 6.
Figure 8:
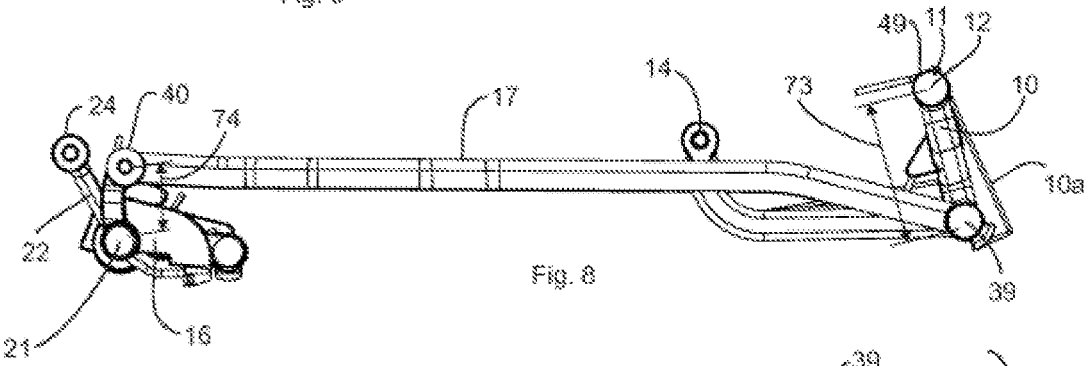
FIG. 8 illustrates a plan view of a lever system of the door handle assembly.
Figure 9:
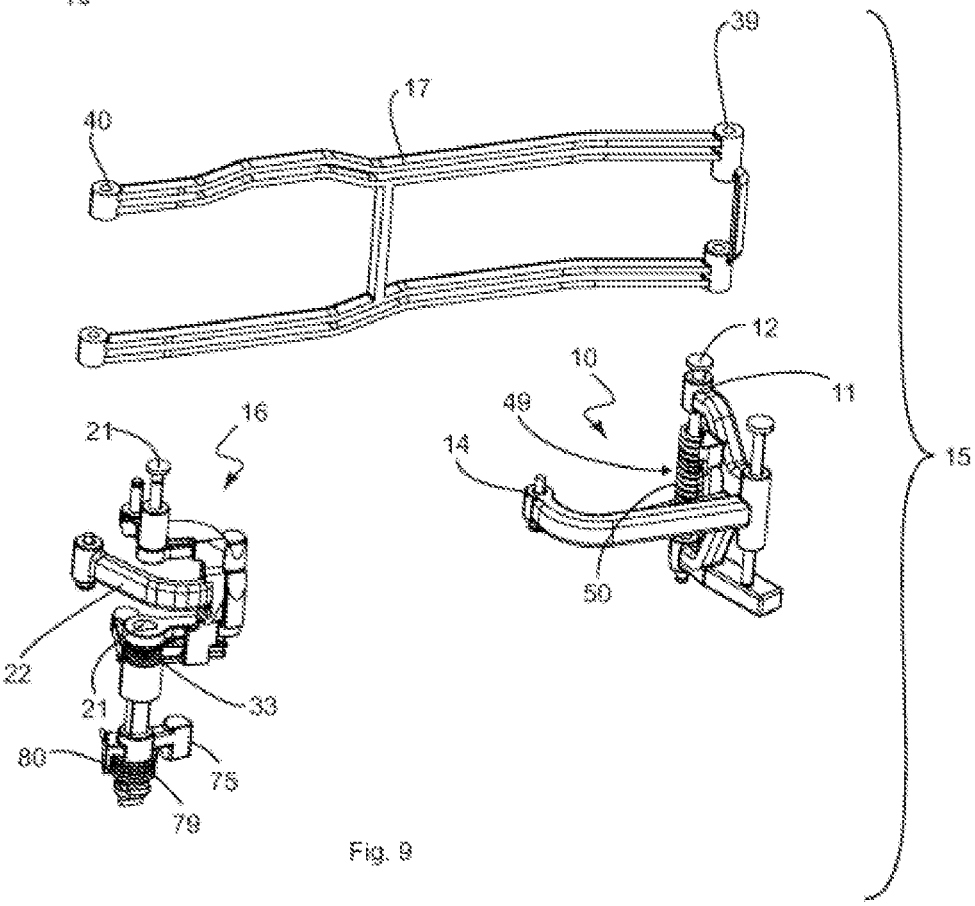
FIG. 9 illustrates a perspective individual part illustration of the lever system of FIG. 8.

In FIGS. 3 to 20*c*, the door handle assembly 3 is shown in various views and for certain details. The door handle assembly 3 has, in addition to the handle 4, a handle housing 8, which is fastened in the installed state internally of the vehicle door 2 and serves, among others, to store the handle 4 in such a manner that the handle 4 in its non-use position is arranged flush with strake with the outer contour 7 of the vehicle door 2 and is movable into its actuation position for actuation by an operator, wherein the handle 4 protrudes in its actuation position with respect to the outer contour 7 of the vehicle door 2 and can be engaged and operated by the operator to open the vehicle door 2 to unlock the door lock 5 formed in the manner of a rotary latch lock. FIG. 3 shows the door handle assembly 3 in a perspective front view, wherein the handle 4 is in its non-use position. The back view of the door handle assembly 3 shown in FIG. 4 illustrates the compact construction of the door handle assembly 3 which takes up little installation space. This compact construction is realized among others by a complex lever system 15, which comprises a lever element 10, a lever mechanism 16 and a movement transfer bracket 17, as the single part illustration in FIG. 5 shows for example. The lever system 15 is further shown in a plan view in FIG. 8 and in a perspective single part view in FIG. 9. Thereby, the lever element 10, the lever mechanism 16 and the movement transfer bracket 17 are mounted on the handle housing 8, which will be described below in detail. By means of the lever system 15, the handle 4 is connected to the handle housing 8. As can be seen further from FIG. 5 by means of the single part illustration, the door handle assembly 3 comprises a vehicle door opening lever 18 and an actuator 19, which are also respectively mounted on the handle housing 8.

As can be seen from the synopsis of FIGS. 3 to 47, a first longitudinal end 9 of the handle 4 is connected to the handle housing 8 via the lever element 10. More specifically, a first lever end 11 of the lever element 10 is attached to a lever pivot axis 12 rotatably mounted on the handle housing 8, wherein a second lever end 14 of the lever element 10 is rotatably connected to the first longitudinal end 9 of the handle 4. The second lever end 14 of the lever element 10 is therefore motion-coupled with the first longitudinal end 9 of the handle 4, when the lever element 10 rotates about the lever rotation axis 12, which will be discussed in more detail in the further description. As for example shown in FIGS. 9 and 10, the lever element 10 is designed as one arm and angled and, with its angled arm in plan view (see, for example, FIGS. 16 to 18), has a U-shaped form. A second longitudinal end 20 of the handle 4 is connected to the handle housing 8 via the lever mechanism 16. The lever mechanism 16 thereby is rotatably mounted on the handle housing 8 by a rotation axis 21, so that the second longitudinal end 20 of the handle 4 is movably attached to the handle housing 8 via the lever mechanism 16. As can be seen for example from FIGS. 5, 9, 11 and 12, the rotation axis 21 for the present exemplary embodiment is formed with two rotation axis sections, wherein a handle lever 22 extends between the two sections of the rotation axis 21.

Figure 12:
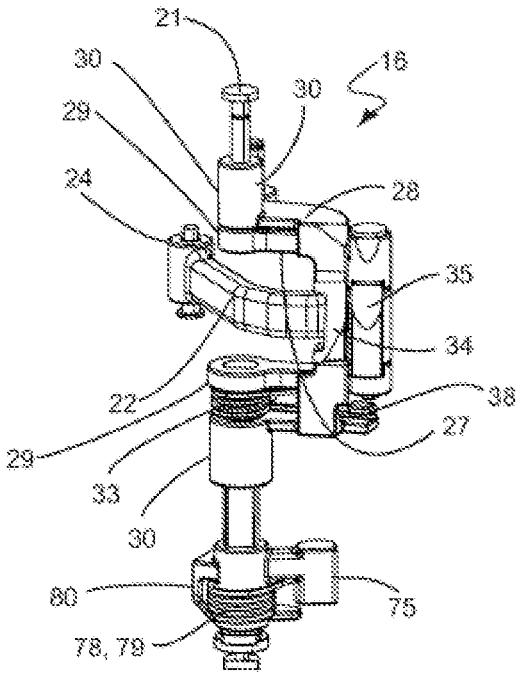
FIG. 12 illustrates a second perspective view of the lever mechanism of FIG. 11.
Figure 13:
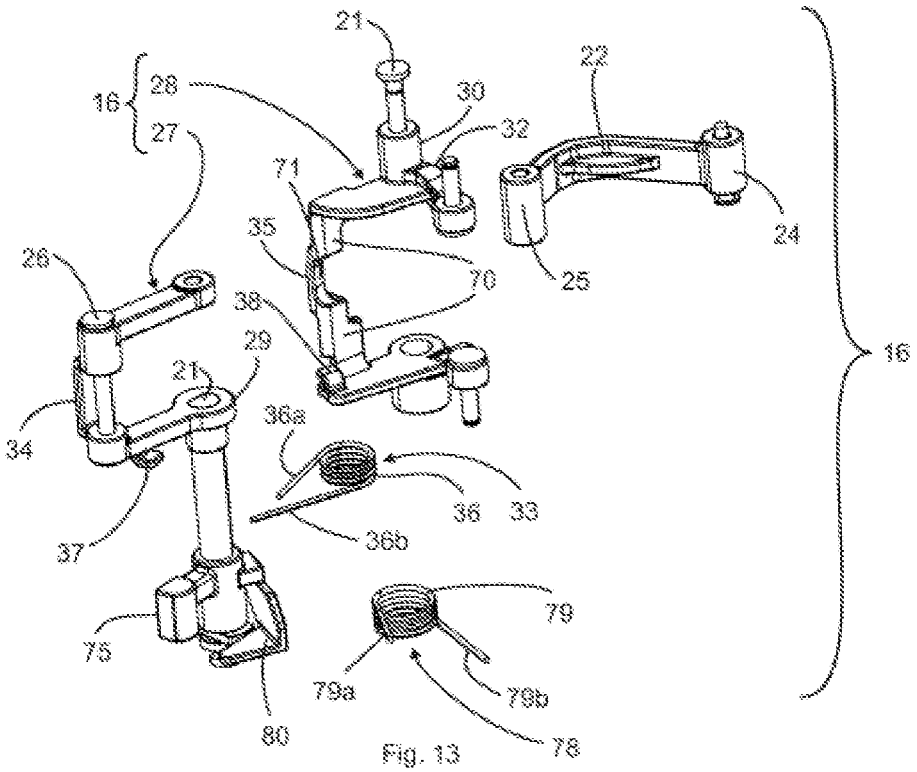
FIG. 13 illustrates a perspective individual part illustration of the lever mechanism shown in FIGS. 11 and 12.
Figure 14:
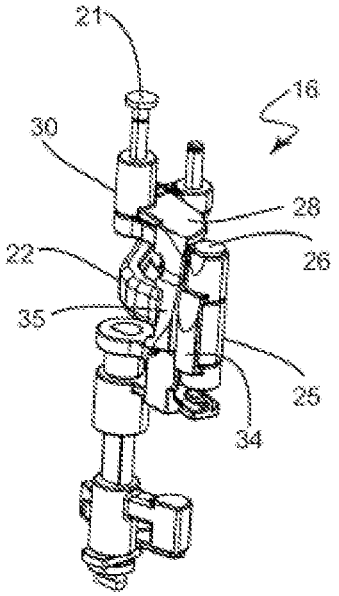
FIG. 14 illustrates a perspective view of the lever mechanism of FIG. 11 arranged in a basic position.
Figure 15:
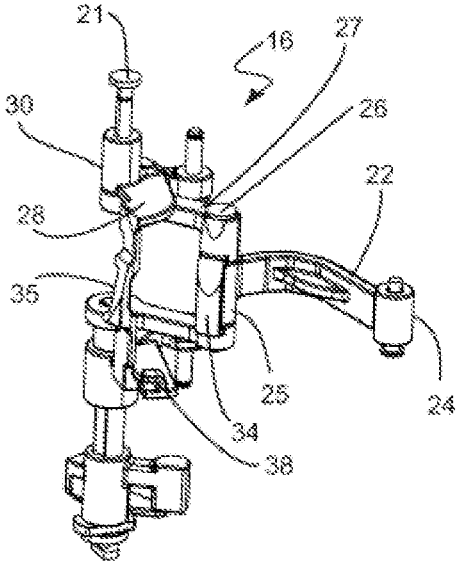
FIG. 15 illustrates a perspective view of the lever mechanism of FIG. 11 arranged in an operating position.

The lever mechanism 16 is shown in more detail in FIGS. 11 to 15 and includes the handle lever 22 and a lever body 23 rotatably mounted on the rotation axis 21. The handle lever 22 is formed with one arm and angled, wherein a first end 24 of the handle lever 22 is rotatably connected to the second longitudinal end 20 of the handle 4. The handle lever 22 is arranged between the two sections of the rotation axis 21, whereby a very compact design can be realized. A second end 25 of the handle lever 22 is rotatably connected to the lever body 23 via a pivot point 26, as for example FIG. 15 shows. The lever body 23 itself has a passive lever 27 and an active lever 28. A first end 29 of the passive lever 27 and a first end 30 of the active lever 28 are mounted on the rotation axis 21 mounted on the handle housing 8 (see for example FIG. 12). The second end 25 of the handle lever 22 is thereby rotatably connected to a second end 31 of the passive lever 27, whereas the first end 29 of the passive lever 27 is rotatably connected to the rotation axis 21 (see for example FIG. 11). In contrast, the first end 30 of the active lever 28 is rotatably connected to the rotation axis 21, so that the active lever 28 is rotatably mounted thereto relative to the rotation axis 21. A lever arm-shaped connecting web 32 projects radially from the first end 30 of the active lever 28. Considering the connecting web 32 as a lever arm of the active lever 28, the active lever 28 can also be considered as a two-armed lever with a first active lever arm 28*a*, which corresponds to the connecting web 32, and a second active lever arm 28*b* (see for example FIG. 18). The special feature of the lever mechanism 16 is the aspect that the passive lever 27 and the active lever 28, which form the lever body 23, act in certain operation procedures of the door handle assembly 3 as a single lever and rotate together about the rotation axis 21, whereas for certain actuation conditions of the handle 4, the passive lever 27 and the active lever 28 rotate relative to each other about the rotation axis 21 and act accordingly as separate levers. For this purpose, the lever mechanism 16 has a holding element 33, which exerts a holding force on the passive lever 27 and the active lever 28. The holding element 33 is arranged between the first end 29 of the passive lever 27 and the first end 30 of the active lever 28 and is held between the two ends 29, 30 (see for example FIG. 12). The passive lever 27 has a contact portion 34, whereas a counter contact portion 35 is formed on the active lever 28, as shown for example in FIG. 15. The holding element 33 thereby exerts a holding force on the passive lever 27 and the active lever 28, whereby the contact portion 34 of the passive lever 27 is pressed against the counter contact portion 35 of the active lever 28. Only when a force acts on the lever body consisting of the passive lever 27 and active lever 28, which is greater than the holding force of the holding member 33, the passive lever 27 can be rotated relative to the active lever 28 about the rotation axis 21, otherwise the passive lever 27 and active lever 28 form a common lever and rotate together about the rotation axis 21. Consequently, the holding element 33 allows a movement of the passive lever 27 relative to the active lever 28 against the holding force exerted by the holding member 3, so that the contact portion 34 of the passive lever 27 is spaced from the counter contact portion 35 of the active lever 28. In the exemplary embodiment shown in the figures, the holding element 33 is formed as an elastic spring element 36, wherein a first leg 36*a* of the spring element 36 engages a hook-shaped holding lug 37 and formed at the passive lever 27 and a second leg 36*b* of the spring element 36 engages a hook-shaped holding lug 38 and formed at the active lever 28, as can for example be seen from FIGS. 11 to 15. The spring element 36 is arranged wound around a section of the rotation axis 21, as can be seen in FIGS. 11 and 12. In FIG. 14, a position of the passive lever 27 and the active lever 28 is shown, in which the contact portion 34 of the passive lever 27 abuts the counter contact portion 35 of the active lever 28, whereas in FIG. 15 another position is shown, in which the contact portion 34 of the passive lever 27 is spaced from the counter contact portion 35 of the active lever 28, from which it can be seen that the passive lever 27 and the active lever 28 are mounted rotatably relative to each other.

Figure 16:
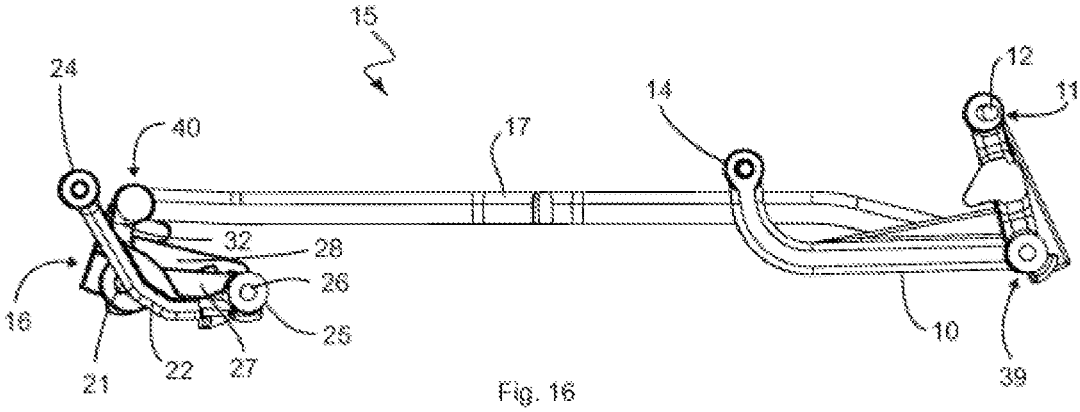
FIG. 16 illustrates a plan view of the lever system of the door handle assembly, when the handle is arranged in a non-use position.
Figure 17:
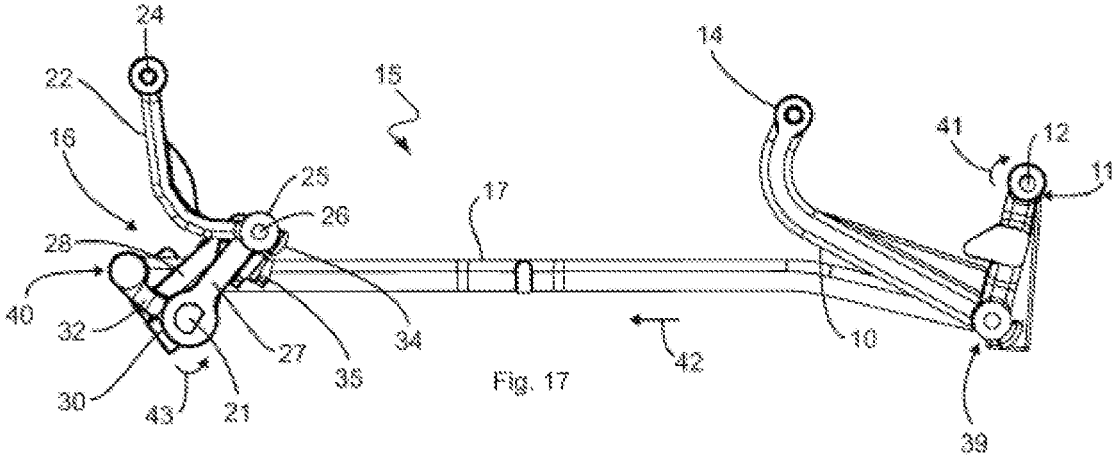
FIG. 17 illustrates a plan view of the lever system of the door handle assembly, when the handle is arranged in an operating position.
Figure 18:
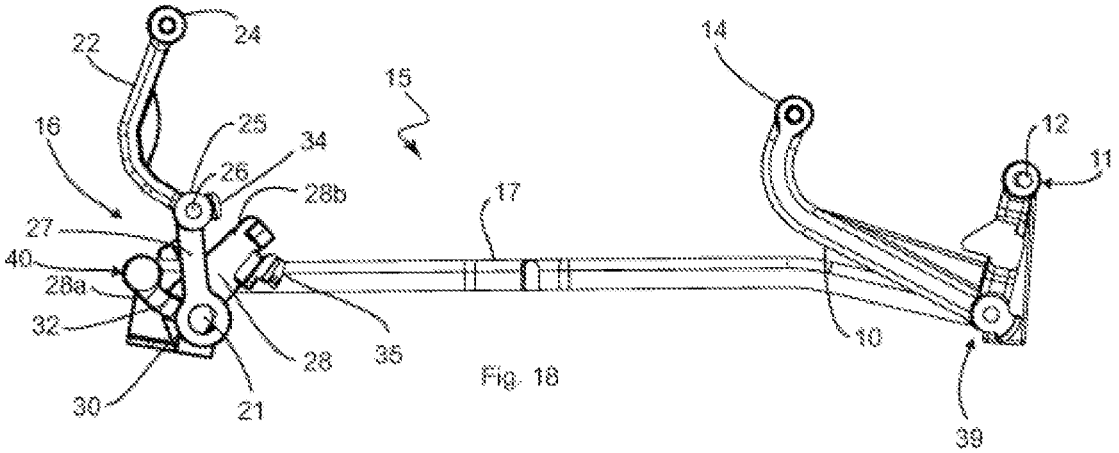
FIG. 18 illustrates a plan view of the lever system of the door handle assembly, when the handle is pulled by an operator for opening the vehicle door.

In FIGS. 16 to 18, different arrangements of the individual components of the lever system 15 are shown as a function of the position of the handle, whereby, for reasons of clarity, only the components of the lever system 15 are shown in a plan view and the other components of the door handle assembly 3 are omitted. Various arrangements of the lever element 10 and the lever mechanism 16 are also shown in FIGS. 19*a* to 20*c*. FIGS. 16, 19*a* and 20*a* thereby show arrangements, in which the handle is arranged in a non-use position extending in a flush with strake manner to the outer contour 7. In contrast, in FIGS. 17, 19*b* and 20*b*, respectively, the handle 4 is arranged in an actuation position, in which the handle 4 is arranged extended opposite the outer contour 7 of the vehicle door 2. In FIGS. 18 and 20*c*, the handle 4 is then respectively shown in a position in which an operator pulls on the handle 4 to open the vehicle door 2. As can be seen among others from FIGS. 16 to 18, the lever element 10 is connected to the lever mechanism 16 in a movement-coupling manner via the movement transfer bracket 17. A first longitudinal end 39 of the movement transfer bracket 17 is thereby rotatably connected to the lever element 10 with a distance or spaced to the lever rotation axis 12. A second longitudinal end 40 of the movement transfer bracket 17 is also rotatably connected to the lever mechanism 16 with a distance or spaced to the rotation axis 21. More specifically, the second longitudinal end 40 of the movement transfer bracket 17 is rotatably connected to the free end of the connecting web 32 or to the first active lever arm 28*a* of the active lever 28. The first longitudinal end 39 of the movement transfer bracket 17 is rotatably connected to the lever element 10 with a lever rotation axis distance 73 to the lever rotation axis 12, whereas the second longitudinal end 40 of the movement transfer bracket 17 is rotatably connected to the lever mechanics 16 with a rotation axis distance 74 to the rotation axis 21 (see for example FIG. 8), wherein the lever rotation axis distance 73 has a greater length than the rotation axis distance 74. When the handle 4 is moved from its non-use position shown in FIGS. 16, 19*a* and 20*a* into the actuation position shown in FIGS. 17, 19*b* and 20*b*, the lever element 10 rotates clockwise according to the arrow 41 about the lever rotation axis 12, whereupon the movement transfer bracket 17 articulated with the lever element 10 is moved in the direction of the lever mechanism 16 or in the direction of the second longitudinal end 20 of the handle 4 (see arrow 42 in FIG. 17) about the lever rotation axis 12. Furthermore, the second lever end 14 of the lever element 10, on which the first longitudinal end 9 of the handle 4 is articulated pivots about the lever rotation axis 12, whereby the handle 4 is moved from its flush with strake position into the actuation position and protrudes from the outer contour 7 of the vehicle door 2, so that an operator can reach behind the handle 4 for actuation. The movement of the movement transfer bracket 17 in the direction of the lever mechanism 16 or in the direction of the second longitudinal end 20 of the handle 4 (see arrow 42 in FIG. 17) effects that the lever mechanism 16 rotates counterclockwise about the rotation axis 21 (see arrow 43 in FIG. 17). This rotary movement is effected by the movement transfer bracket 17, which is motion-coupled and articulated to the connecting web 32 or the first active lever arm 28*a* of the active lever 28 with its second longitudinal end 40. During this rotational movement of the lever mechanism 16, the holding force of the holding element 33 is sufficient, so that the holding element 33 presses the contact portion 34 of the one-armed passive lever 27 against the counter contact portion 35 of the active lever 28. However, with this rotational movement, the lever mechanism 16 of the handle lever 22 pivots, which is connected in an articulated manner to the handle 4 at its first end 24 and which is connected in an articulated manner to the second end 31 of the passive lever 27 at its second end 25. The pivoting movement of the handle lever 22 results in that the second longitudinal end 20 of the handle 4 is also moved out from the outer contour 7 of the vehicle door 2. During the movement of the handle 4 from the non-use position to the actuation position, the handle 4 is first extended from the outer contour 7 of the vehicle door 2 on its longitudinal end 9 and then the handle 4 on its second longitudinal end 20 by means of shorter lever lengths 10 compared to the lever length of the lever mechanism 16, wherein the handle 4 is extended from the outer contour 7 at its first longitudinal end 9 less than at its second longitudinal end 20. More specifically, in a movement from the non-use position to the actuation position, the handle 4 is extended at its first longitudinal end 9 by about 28 mm and at its second end 20 by about 44 mm, whereby the handle 4 is arranged not parallel, but oblique to the outer contour 7 of the vehicle door 2. The oblique arrangement of the handle 4 in its actuation position is possible among others, that a handle lever leg 44 terminating at the first end 24 of the handle lever 22 is formed with a handle lever length 45 which is at least 1.25 times larger than a lever element length 46 of a lever element leg 47 terminating at the second lever end 14 of the lever element 10 (see, for example, FIGS. 19*a* and 20*c*). When the handle 4 is actuated by an operator from the operating position, this is a pulling movement on the handle 4, whereby it reaches the position shown in FIGS. 18 and 20*c*. In this position, the lever element 10 is still arranged in the position which it had already reached in the actuation position. Consequently, there is no further rotation about the lever rotation axis 12. Rather, a relative movement between the passive lever 27 and the active lever 28 takes place on the lever mechanism 16, wherein the operator has to apply a force in during his pulling movement of the handle 4 for this, which is greater than the holding force of the holding element 33. If this is the case, then the passive lever 27 is moved relative to the active lever 28 by the force of the operator on the handle 4, wherein the active lever 28 remains in its position, which it has already taken in the actuation position of the handle. As can be seen from FIGS. 18 and 20*c*, the contact portion 34 of the passive lever 27 is spaced from the counter contact portion 35 of the active lever 28, as the arrow 48 in FIG. 20*c* shows. The passive lever 27 thus assumes in comparison to its arrangement in the actuation position of the handle an extended position and pointing toward the handle 4, which the second longitudinal end 20 of the handle 4 still further protrudes from the outer contour 7 of the vehicle door 2. More specifically, in FIG. 20*c*, the passive lever 27 and the handle lever 22 take respective positions representing a maximum extension of these two levers 22, 27, because both of the levers 22, 27 are arranged transversely of the handle housing 8 or aligned to the movement transfer bracket 17, so that this arrangement realizes a maximum deflection of the second longitudinal end 20 of the handle 4. Consequently, it is characteristic for the lever system 15 of the door handle assembly 3 according to the invention, that upon movement of the handle 4, the second lever end 14 of the lever member 10 is constantly spaced from the lever rotation axis 12, whereas the first end 24 of the handle lever 22 is arranged at a varying space from the rotation axis 21 as a function of the movement position of the handle 4.

The operation of the inventive door handle assembly 3 and other technical characteristics of the invention will be described below.

In FIGS. 21 to 24, the handle 4 of the door handle assembly 4 is arranged in its non-use position, in which the handle 4 is arranged flush with strake with the outer contour 7 of the vehicle door 2. In other words, the handle 4 in its non-use position is positioned flush-mounted in a door panel representing the outer contour 7. A mechanical reset element 49 presses the handle 4 into its non-use position shown in FIG. 21 and holds it in this position, wherein the mechanical reset element 49 permits movement of the handle 4 from the non-use position in the direction of the actuation position against a reset force generated by the mechanical reset element 49. In the exemplary embodiment shown, the mechanical reset element 49 is designed as a reset spring 50, which is wound around the lever rotation axis 12 (see for example FIGS. 9 and 10). Thereby, a first spring leg 50*a* of the reset spring 50 is supported on the handle housing 8, whereas a second spring leg 50*b* of the reset spring 50 is supported on the lever element 10. The handle 4 is thus pressed into the non-use position against the seals and end stops not shown in the figures by means of the reset spring 50. An injury of the hand of the operator is however not possible with a held handle 4, as the reset force of the reset spring 50 is not dimensioned so strongly that a seriously injurious pinching of the hand of the operator would be possible. The synopsis of FIGS. 22 to 24 shows by means of the non-use position of the handle 4 some of the many special features of the door handle assembly 3 according to the invention. In FIG. 22, the handle housing 8 has been omitted for the sake of better clarity. As FIG. 22 shows, the lever element 10 with the lever mechanism 16 is motion-coupled via the movement transfer bracket 17, so that rotation of the lever element 10 about the lever rotation axis 12 results in rotation of the lever mechanism 16 about the rotation axis 21. The vehicle door opening lever 18, which is rod-shaped, is mounted on the handle housing 8 via two movable pivot points 18*a* movable in parallel to the movement transfer bracket 17, wherein a Bowden cable lever extends radially from one of the two pivot points 18*a*, to which a Bowden cable is attached, which in turn is connected to the door lock 5 of the vehicle door 2 and serves to unlock the door lock 5 in a known manner. According to the invention, in the non-use position of the handle 4, the lever element 10 and the lever mechanism 16 are engaged with the movement transfer bracket 17. In other words, in the non-use position of the handle 4, the lever element 10 and the lever mechanism 16 are decoupled from the movement transfer bracket 17, whereby the invention differs from the known prior art, where a sustained and permanent connection exists between the handle and the Bowden cable for all positions of the handle. In the non-use position of the handle, the movement transfer bracket 17 is arranged in a standby position (see for example FIG. 22) from which it is movable into an unlocking position to unlock the door lock 5 formed like a rotary latch lock.

Another special feature of the invention is, in addition to the decoupling of the Bowden cable lever 18 from the handle 4 in its non-use position, that also in the non-use position of the handle 4, a motor-driven actuator 19 does not have a firm connection to the lever element 10 and the lever mechanism 16. Expressed differently, the motor-driven actuator 19 is decoupled from the lever element 10 and the lever mechanism 16 in the non-use position of the handle 4 and has no fixed connection to the lever element 10 and the lever mechanism 16. The actuator 19 is therefore not in engagement with the lever element 10 and with the lever mechanism 17 when the handle 4 is arranged in its non-use position. The motor-driven actuator 19 is mounted on the handle housing, wherein a motor drive shaft 51 of an electric motor drives and rotates the actuator 19. According to the invention, in the non-use position of the handle 4, both the movement transfer bracket 17 serving for unlocking the door lock 5 and the actuator 19 are decoupled from the lever element 10 and the lever mechanism 16. In the non-use position of the handle 4, the actuator 19 assumes a rest position shown in FIGS. 23 and 24.

With reference to FIGS. 25 to 29, various views are shown for a current-driven normal operation of the door handle assembly 3 according to the invention. In a current-driven normal operation of the door handle assembly 3, an approach by an authorized operator to the vehicle 1 is detected in a known manner, whereupon a signal from the vehicle control controller is sent to the electric motor, which then starts its operation and rotates the actuator 19 via the motor drive shaft 51. The electric motor is thereby energized for a predetermined period of time and rotates the actuator 19 about the motor drive shaft 51 by an angle in a range of 90° to 130°. The actuator 19 thereby passes from its rest position into a handle extension position shown in FIGS. 26 and 27. The actuator 19 is thus rotatably mounted on the motor axis shaft 51 on the handle housing. As can be seen from FIGS. 26 and 27 in conjunction with FIGS. 6 and 7, the motor-driven actuator 19 is formed disk-shaped with a non-uniform edge 52. During a rotational movement of the actuator 19 about the motor drive shaft 51, in which the actuator 19 is rotated from its rest position to its handle extension position, the non-uniform edge 52 cooperates with a lever lug 10*a* formed on the lever element 10. The non-uniform edge 52 has a first edge portion 53 with a radius increasing from a minimum radius 54 to a maximum radius 55 and a second edge portion 56 with the maximum radius 55. As can be seen in particular from FIGS. 6 and 26, the maximum radius 55 is formed larger than the minimum radius 54. The non-uniform edge 52 further includes a third edge portion 57 having the minimum radius, wherein the third edge portion 57 is formed in front of the first edge portion 53 and the second edge portion 56 extends between the first edge portion 53 and the third edge portion 58. The transition from the second edge portion 56 to the third edge portion 57 is thereby formed abruptly. In the current-driven normal operation, the motor-driven actuator 19 rotates the lever element 10 from its rest position counterclockwise about the lever rotation axis 12, as shown by the arrow 58 in FIG. 26, wherein the rotation is a uniform handle extension rotary movement of the motor-driven actuator 19. In this uniform handle extension rotary movement of the motor-driven actuator 19 from the rest position into the handle extension position, the first edge portion 53 presses with increasing radius against the lever lug 10*a* of the lever element 10 and thus moves the handle 4 via the lever element 10 from the non-use position into its actuation position shown in FIG. 25, in which the handle 4 protrudes with respect to the outer contour 7 of the vehicle door 2. The uniform handle extension rotary movement of the motor-driven actuator 19 stops when the second edge portion 56 of the motor-driven actuator 19 abuts the lever lug 10*a* of the lever element 10. The motor drive shaft 51 rotates the actuator 19 by an angle in a range of 90° to 130° by means of the uniform handle extension rotary movement, thereby ensuring that the lever lug 10*a* abuts the second edge portion 56, so that the first longitudinal end 9 of the handle 4 is arranged extended with respect to the outer contour 7 of the vehicle door 2. It should be noted that the lever lug 10*a* of the lever element 10 abuts the third edge portion 57 when the handle 4 is arranged in the non-use position and the motor-driven actuator 19 is arranged in the rest position, as can be seen from FIG. 23. Returning to FIGS. 25 to 29, it can be seen that the vehicle opening lever 18 arranged in the actuation position of the handle 4 is still arranged in the ready position, in which the Bowden cable lever 18*b* does not effect unlocking of the door lock 2. This is due to an unlocking contour 59, which is formed on one of the two side surfaces (upper side or lower side) of the disk-shaped and motor-driven actuator 19. During a movement of the actuator 19 from the handle extension position to the door opening position, the unlocking contour 59 cooperates with the vehicle door opening lever 18. As can be seen from FIG. 7, the unlocking contour 59 has a first contour portion 60 with a constant neutral radius 61, a second contour portion 62 with a progression radius 63 and a third contour portion 64 with a constant radius 65. The constant radius 65 is thereby greater than the neutral radius 61, wherein the constant radius 65 and the neutral radius 61 each have a constant radius. Further, the progression radius 63 is a radius increasing from the neutral radius 61 to the constant radius 65. As can be seen from FIGS. 26 and 27 in synopsis with FIGS. 6 and 7, the constant radius 65 of the unlocking contour 59 is smaller than the maximum radius 55 of the non-uniform edge 52 of the motor-driven actuator 19. As an alternative to the unlocking contour formed on the actuator 19, it is also conceivable that a cam disk is rotatably supported on the handle housing 8 in addition to and separately from the motor-driven actuator 19 via the motor drive shaft 51, the cam disc cooperating with the vehicle door opening lever 18, to move from the standby position into an unlocking position, wherein the unlocking position will be discussed below. In the current-driven normal mode of operation of the door handle assembly, during a rotary movement of the motor-driven actuator 19, when it rotates from the rest position into the handle extension position, the first contour portion 60 with a neutral radius 61 moves tangentially past a longitudinal end 66 of the vehicle opening lever 18 (see FIG. 27), so that the vehicle opening lever 18 still remains arranged in the standby position. The uniform handle extension rotary movement of the actuator 19 effects—as explained—a rotation of the lever element 10 about the lever rotation axis 12, whereby on the one hand the handle 4 is extended at its first longitudinal end 9 and on the other hand the movement transfer bracket 17, which is motion-coupled to the lever element 10 with its first longitudinal end 39 and rotatably connected, is moved in the direction of the lever mechanism 16 (see arrow 67). Furthermore, at the end of the uniform handle extension rotary movement of the actuator 19, the second longitudinal end 40 of the movement transfer bracket 17 comes into abutment with the handle housing 8. Consequently, the actuator 19 presses the second longitudinal end 40 of the movement transfer bracket 17 at least in portions against a locking stop 67 attached to the handle housing 8 (see FIG. 29), so that the movement transfer bracket 17 is secured with its second longitudinal end 40 and abuts the handle housing 8 in a wobble-free and tilt-free manner. Furthermore, the motor-driven actuator 19 presses a support lug 68 formed on the lever element 10 at least in sections against a support stop 69 formed on the handle housing 8 (see FIG. 28), so that the movement transfer bracket 17 with its first longitudinal end 39 is likewise secured and abuts the housing 8 in a wobble-free and tilt-free manner. By the movement of the movement transfer bracket taking place parallel to the handle housing 8 due to the rotation of the lever element 10 clockwise about the lever rotation axis (see arrow 41), the movement transfer bracket 17 rotates the lever mechanism 16 counterclockwise about rotation axis 21 (see arrow 43), as it has already been described for FIG. 17, to which reference is made at this point in order to avoid repetitions. The movement transfer bracket 17 cooperates with the active lever 28 and rotates the active lever 28 about the rotation axis 21. Thereby, the passive lever 27 and the active lever 28 rotate as the common lever body 23 about the rotation axis 21, because the holding force of the holding element 33 presses the contact portion 34 of the passive lever 27 against the contact portion 35 of the active lever 28, wherein the passive lever 27 in this rotary movement abuts support surfaces 70 (see for example FIG. 13), which abut the passive lever 27 during the rotational movement, so that the active lever 28 rotates together with the passive lever 27 when the actuator 19 rotates from its rest position to the handle extension position. The force transferred to the lever mechanism 16 by means of the movement of the movement transfer bracket 17 effects that the handle lever 22 assumes the position seen in FIGS. 26 and 29. The first end 24 of the handle lever 22 cannot move otherwise due to its coupling with the handle 4 and moves away from the rotation axis 21, whereby the second longitudinal end 20 of the handle 4 is also extended from the outer contour 7 of the vehicle door 2, if the actuator 19 is arranged in the handle extension position. The connection of the second longitudinal end 20 of the handle 4 is thus formed in the manner of a toggle lever, wherein the active lever 28 and the passive lever 27 are held by the holding force of the holding element 33 at least in the non-use position of the handle 4 in a stable manner in their abutting position and wherein, with the movement of the handle 4 in its actuation position, the support surfaces 70 of the active lever 28 move the passive lever 27, when the lever mechanism 16 rotates about the rotation axis 21. Due to the different length design of the handle lever length 45 of the handle lever 22 and the lever element length 46 of the lever element 10, in the current-driven normal operation, when extending the handle 10 from its non-use position to its actuation position, the first longitudinal end 20 of the handle 4 is extended from the outer contour 7 of the vehicle door 2 before the second longitudinal end 20 of the handle 4. By this time delayed extension movement of the two longitudinal members 9 and 20 of the handle, a better breakaway of the handle 4 is realized with icing. The temporal delay is thereby achieved as follows. The active lever 28 of the lever body 23 has a support element 71 (see for example FIG. 13), at which the handle lever 22 abuts at least partially in the non-use position of the handle 4 and with a movement of the handle 4 in the direction of its actuation position until exceeding a dead center 72. Only when the second end 25 of the handle lever 22 has exceeded the dead center 72, the handle lever 22 lifts from the support element 71 and extends the second end 20 of the handle 4. In other words, the lever element 10 with rotation about the lever rotation axis 12, extends the longitudinal end 9 of the handle 4 from the outer contour 7 and the lever mechanism 16 extends the second longitudinal end 20 on the onset of rotation about the rotation axis 21 only after exceeding the dead center 72 of the handle lever 22 from the outer contour 7, although the lever element 10 is motion-coupled with the lever mechanism 16 in such a manner, that during the movement of the handle 4 from the non-use position into the actuation position, the lever element 10 rotates about the lever rotation axis 12 and at the same time rotates the lever mechanism 16 about the rotation axis 21. Further, the handle 4 is not only perpendicular to the handle housing 8, but also pivoted transversely to this direction, which supports the better breakaway. The handle 4 is extended by the actuator 19 in normal operation until the movement transfer bracket 17 abuts the locking stop 67 and the support lug 68 abuts the support lug 69. The movement transfer bracket 17 is thereby held wobble-free in position between the actuator 19 and the locking stop 67. Due to the different lever lengths, the handle 4 extends approximately 28 mm at its first longitudinal end 9 and approximately 40 mm at its second longitudinal end 20, so that the handle 4 is arranged in its operating position obliquely to the outer contour 7 and to the handle housing 8. Due to the compact lever system 15 and its compact lever movement when extending the handle 4, installation space can be saved in critical locations, as for example the window guide of the vehicle door 2. It is characteristic of the door handle assembly 3 that upon movement of the handle 4, the second lever end 14 of the lever element 10 is constantly spaced from the lever rotation axis 12, whereas the first end 24 of the handle lever 22 is arranged at a varying distance depending on the movement position of the handle 4. For the operation of the door handle assembly 3 with the handle 4 connected to the handle housing 8 via the lever element 10 and the lever mechanism 16, it is characteristic among others, that in the movement from the non-use position into the actuation position, the first longitudinal end 9 of the handle 4 is extended from the outer contour 7 of the vehicle door 2 and the second longitudinal end 20 of the handle 4 is extended in a delayed manner by the lever mechanism 16 to the first longitudinal end 9 of the handle 4, wherein the second longitudinal end 20 of the handle 4 is extended further by the lever mechanism 16 than the first longitudinal end 9 of the handle 4 and wherein the first longitudinal end 9 of the handle 4 is extended in time before the second longitudinal end 20 of the handle 4. During the movement of the handle 4 from its non-use position to the actuation position, the lever mechanism 16 is rotated about the rotation axis 21 until an actuating lug 75, which extends radially from the first end 29 of the passive lever 27, comes almost into engagement with a hook-shaped driver portion 76, that is formed on the vehicle opening lever 18, as shown in FIG. 27. Instead of the design described above, the actuation lug 75 in the exemplary embodiment shown, is formed as a separate component which is non-rotatably connected to the rotation axis 21. When the handle 4 is arranged in the actuation position and the lever mechanism 16 has assumed its corresponding position, a small gap remains between the actuating projection 75 and the driver section 76.

This small gap between the actuating projection 75 and the driver section 76 is required so that no mechanical opening of the door lock 5 takes place by a slight pulling on the handle 4 caused by an operator. For a slight pulling on the handle 4 shall cause a servo unlocking of the door lock 5. The servo unlocking effected by the operator shall therefore be possible for the operator with respect to a purely mechanical unlocking with a reduced force. The servo unlocking consequently supports the operator in unlocking, by detecting the pulling force applied by the operator and by the actual unlocking procedure taking place through the drive motor. FIGS. 30 to 36 show arrangements of the individual components of the door handle assembly 3, when the handle 4 is moved from the actuation position into a servo opening position by means of actuation by an operator. The actuation of the operator is thereby a pulling movement of the handle 4, wherein in FIGS. 30 to 36, the handle 4 is arranged in the servo opening position for a current-driven normal operation of the door handle assembly 3. In the servo actuation by the operator, one pulls on the handle 4, which is arranged in its actuation position. As the handle 4 is not further movable in its actuation position at its first longitudinal end 9, the pulling movement by an operator leads to the fact that the handle 4 is further drawn outwards at its second longitudinal end 20 with respect to the outer contour 7 and the lever mechanism 16 thereby rotates approximately 3° about the rotation axis 21, whereby the handle 4 is arranged in the servo opening position shown in FIG. 30. This rotary movement effected by the operator, which is transmitted via the handle lever 22 to the passive lever 27, takes place against the holding force of the holding element 33. The rotation of the passive lever 27 effected by the operator thereby takes place against a counterforce exerted by a counterforce element 78. The operator is thus experiencing a power increase during a servo actuation of the handle 4, which equates to a stop that is felt by the operator, so that he will not continue to try to pull the handle 4 further out. The counterforce element 78 (see, for example, FIGS. 35 and 36) can be arranged on a longitudinal portion of the passive lever 27. In the exemplary embodiment shown, the counterforce element 78 is arranged at the actuation lug 75 and formed as an elastic leg spring element 79, wherein a first leg 79*a* of the leg spring element 79 is supported on the actuation lug 75 and a second leg 79*b* of the leg spring element 79 abuts a hook-shaped holding lug 80, which projects radially from the actuation lug 75. The second leg 79*b* of the leg spring element 79, comes, with the movement of the handle 4, from the actuation position into the servo opening position, into abutment at a limit stop 81 formed at the handle housing 8 (see, for example, FIG. 41), so that the leg spring element 79 in the servo actuation position of the handle 4 is compressed generating the counterforce. The rotation or rotation of the passive lever 27, which is non-rotatably connected to the rotation axis 21, is detected by a detection means 77 arranged on the handle housing 8. The detection means 77 is only indicated by way of example in FIGS. 31 and 33 and may be a Hall sensor, whereby a movement of the handle 4 from the actuation position to the servo opening position can easily be detected or recorded, in order to send a corresponding signal to the vehicle control controller or directly to the drive motor, wherein the drive motor then moves the actuator 19 from its handle extension position (see FIGS. 31, 32 and 35) into a door opening position (see FIGS. 33, 34 and 36), whereby the vehicle door opening lever 18 is then moved by the actuator 19 from its standby position into an unlocking position, in which the vehicle door 2 can be opened. However, other sensors or detection means are also conceivable in order to detect a movement of the handle 4 and to activate a drive motor for moving the actuator 19. The motor-driven actuator 19 and which is motion-coupled to the lever element 10 is thus mounted movably between the rest position into the door opening position on the handle housing 8. Thereby, the detection means 77 is formed in such a manner that it, when detecting a movement of the handle 4 from the actuation position into the servo-opening position, effects a movement of the motor-driven actuator 19 from the handle extension position into the door opening position. While FIGS. 31 and 33 show a plan view of the individual levers and the actuator 19 of the door handle assembly 3, FIGS. 32 and 34 show a bottom view of the actuator 19, the actuator lug attachment 75 connected non-rotatably to the rotation axis 21 in a rotationally fixed manner, and the vehicle door opening lever 18. The motor-driven actuator 19 is motion-coupled to the vehicle door opening lever 18 mounted movably on handle housing 8 between the standby position and the unlocking position. Thereby, in its movement from the handle extension position (see for example FIG. 31) into the door opening position (see for example FIG. 33), the vehicle door opening lever 18 moves from the standby position into the unlocking position, in which the vehicle door 2 can be opened. The movement of the motor-driven actuator 19 from the rest position via the handle extension position into the door opening position is a rotary movement about the motor drive shaft 51. During the rotary movement of the actuator 19 from the handle extension position into the door opening position, the unlocking contour 59 cooperates with the longitudinal end 66 of the vehicle door opening lever 18, while the second edge portion 56 of the non-uniform edge 52 with its constant maximum radius 55 holds the lever element 10 in position. By means of the detection means 77, the rotation of the passive lever 27 is detected, whereupon the drive motor is put back into operation and continues to rotate the actuator 19 counterclockwise (see arrow 58 in FIG. 33). This rotation corresponds to a door unlocking rotary movement of the motor-driven actuator 19 from the handle extension position into the door opening position, where the second contour portion 62 and then the third contour portion 64 of the unlocking contour 59 presses against the longitudinal end 66 of the vehicle door opening lever 18 and pushes the vehicle door opening lever 18 from its standby position into its unlocking position for opening the vehicle door 2, as it is then shown in FIG. 34. The door unlocking rotary movement then stops, just before the third edge portion 57 of the motor-driven actuator 19 reaches the lever lug 10*a* of the lever element 10. But beforehand, the door lock 5 has already been unlocked, so that a detection of the door lock unlocking can be used to stop the drive motor. The ready position is shown in FIG. 35, whereas FIG. 36 shows the unlocking position of the vehicle door opening lever 18. In the unlocking position, the Bowden cable lever 18*b* is pivoted about its pivot point 18*a*, so that the movement effected by the motor-driven actuator 19 in the normal operation of the vehicle door opening lever 18 effects a pulling movement at a Bowden cable mounted thereon, whereby the door lock 5 can be unlocked and the vehicle door can be opened. After the servo actuation by the operator, the handle 4 passes again into its actuation position through the holding force of the holding element 33. After opening the vehicle door 2 or after a predetermined period of time or due to a corresponding signal of an electronic vehicle key, the handle 4 is then moved back to its non-use position, for which purpose the actuator 19 is again turned back to its rest position, so that the handle 4 reaches its non-use position by means the reset force of the reset spring 50.

As already mentioned above, the vehicle door opening lever 18 mounted on the handle housing 8 is movable between the standby position and the unlocking position unlocking or opening the vehicle door 2. The movement to the unlocking position for a current-driven normal operation of the door handle assembly 3 has been described above. The vehicle door opening lever 18 is however also movable into the unlocking position in a currentless emergency operation, which is done by an actuation of the handle 4 by the operator. This situation is illustrated in FIGS. 37 to 41. The handle 4 is, for emergency operation, which may occur in case of failure of the electrical supply of the vehicle 2 or failure of the drive motor, mounted movably by the operator from the actuation position into an opening position, which can also be referred to as an emergency actuation position, for manual door opening. In FIG. 37, the handle is arranged in this emergency actuation position, which is a position in which the handle is pulled out from the actuation position beyond the servo opening position from the outer contour 7 of the vehicle door 2. From the above description for normal operation, it can be seen that the handle 4 is decoupled from the vehicle door opening lever 18 in its non-use position and in its actuation position. In the door handle assembly 3 according to the invention, the handle 4 couples, in an emergency operation in a movement from the actuation position into the emergency actuation position, with the vehicle door opening lever 18, wherein the handle 4 moves the vehicle door opening lever 18 into the unlocking position, as indicated by the arrow 42 in FIG. 34. In particular, the handle 4, with a movement from the actuation position into the emergency actuation position, couples with o the vehicle door opening lever 18. In the emergency operation, with the movement of the handle 4 from the actuation position to the direction of the emergency actuation position, the actuation lug 75 engages the cam portion 76 and presses the vehicle door opening lever 18 from the ready position to the unlocking position (see FIG. 39). By pulling on the handle 4, the lever mechanism 16 is rotated about the rotation axis 21 by about 7°, whereby this movement takes place against the holding force of the holding element 33 and against the counterforce of the leg spring element 79. The operator therefore has to apply a much higher force compared to normal operation in order to move the handle 4 into the emergency actuation position and to turn the Bowden cable lever 18*b* for unlocking the door lock 5. By overcoming the holding force of the holding element 33, the passive lever 27 is rotated away from the active lever 28, so that the passive lever 27 no longer abuts to the active lever 28 (see for example FIG. 40). In addition, the operator must move the handle 4 against the counterforce of the leg spring 79 to urge the vehicle door opening lever 18 into the unlocking position. During this movement of the handle 4 in the direction of the emergency actuation position, the second leg 79*b* of the leg spring element 79 comes into abutment with the limit stop 81 formed on the handle housing 8, whereby the leg spring element 79 is compressed in the emergency actuation position of the handle 4 to generate the counterforce (see FIG. 41). The actuation of the handle 4 is more difficult than the servo actuation by the application of the two spring elements 33 and 79. The extended position of the passive lever 27 in FIG. 38 simultaneously represents a mechanical end stop, as the handle 4 cannot be moved further than into this position. Due to the spring force of the door lock 5, the vehicle door opening lever 18 is repeatedly moved back into its initial position via the Bowden cable, that is, into the standby position, when the force of the operator no longer acts on the handle 4.

The above-described emergency operation of the door handle assembly 3 presumes that the handle 4 is arranged in its actuation position or in a position in which the operator can reach behind the handle 4 for actuation. If the handle 4 is in its non-use position and a currentless emergency operation is given, the invention provides for the door handle assembly 3 that, in the event of failure of the motor-driven actuator 19, the handle 4 can be moved into an emergency handling position by the operator shown in FIG. 43. In the emergency handling position, the first longitudinal end 9 of the handle 4 with respect to the non-use position is moved toward the handle housing 8 and the second longitudinal end 20 of the handle 4 is moved away from the handle housing 8. The holding element 33 thereby permits a movement of the first longitudinal end 9 of the handle 4 in the direction of the handle housing 8 and relative to the second lever end 14 of the lever element 10 and a movement of the second longitudinal end 20 of the handle 4 directed away from the handle housing 8 against the holding force exerted by the holding element 3. This is possible because the connection of the second longitudinal end 20 of the handle 4 takes place via the via lever mechanism 16 executed in the manner of a toggle, in which the passive lever 27 and the active lever 28 are held by the holding force of the holding element 33 in a stable and abutting position. The first end 29 of the passive lever 27 is non-rotatably connected to the rotary axis 21, wherein the first end 30 of the active lever 28 is rotatably connected to the rotary axis 21. As described above, in the non-use position of the handle 4, the holding element 33 presses the contact portion 34 of the passive lever 27 against the counter contact portion 35 of the active lever 28. In contrast, in the emergency handling position of the handle 4, a pressing force exerted by the operator and exceeding the holding force of the holding element 33 acts on the first longitudinal end 9 of the handle 4, whereby the contact portion 34 of the passive lever 27 is arranged turned away from the counter contact portion 35 of the active lever 28 (see for example FIGS. 43 and 45, wherein FIG. 44 shows a position of the lever mechanism 16, in which the handle 4 is arranged in its non-use position). In the movement from the non-use position to the emergency handling position, the handle 4 transmits a pressing force exerted by the operator on the first longitudinal element 9 (see arrow 84) to the passive lever 27 of the lever mechanism 16 via the second longitudinal member 20, which effects a relative rotation of the passive lever 27 to the active lever 28, so that, in the emergency handling position, the contact portion 34 of the passive lever 27 is arranged spaced from the counter contact portion 35 of the active lever 28. So that no unwanted movement of the handle 4 takes place in the emergency handling position, the holding force of the holding element 33 is dimensioned so that the holding element 33, up to an acceleration force acting in the event of a vehicle accident or up to a pressing force exerted by the operator of at least 30 g, the abutment portion 34 of the passive lever 27 presses against the counter abutment portion 35 of the active lever 28. So that the handle 4 cannot be pushed indefinitely into the outer contour 7 of the vehicle door 2 when the holding force is overcome, the lever element 10 has a support lug 82 between its first lever end 11 and its second lever end 14. In the emergency handling position, the support lug 82 abuts a motion limit lug 83 formed on the handle 4 and limiting the movement of the handle 4 in the direction of the handle housing 8, as shown in FIG. 47, wherein FIG. 46 shows the position of the handle 4 in its non-use position. In other words, in this emergency operation, in which the handle 4 is in its non-use position, the handle 4 is pressed in at its first longitudinal end 9, whereby the second longitudinal end 20 of the handle 4 is unscrewed via the lever mechanism 16. As a result, the handle 4 can be detected by the operator and completely pulled out of the outer contour 7 of the vehicle door 2 into the emergency actuation position and be actuated mechanically.

Finally, it should be mentioned that the handle 4 is connected by means of corresponding screw means at its first longitudinal end 9 and at its second longitudinal end 20 to the lever system 15, in particular to the lever element 10 and the handle lever 22, in an articulated manner. By loosening the screw means in a position of the handle 4 extended from the outer contour 7 of the vehicle door 2, the handle 4 itself can be exchanged.

Further preferred embodiments of the present invention are described in the following sections:

A further preferred embodiment of the invention relates to a door handle assembly 3 for a vehicle door 2 with a handle housing 8 attachable to the vehicle door 2, a handle 4 mounted on the handle housing 8, which, in a non-use position, is arranged proceeding flush with strake with an outer contour 7 of the vehicle door 2 and which, for actuation by an operator into an actuation position, in which the handle 4 protrudes from the outer contour 7 of the vehicle door 2 and can be actuated by the operator to open the vehicle door 2, is movable, a lever element 10, of which a first lever end 11 is rotatably attached to a lever rotary axis 12 mounted on the handle housing 8 and of which a second lever end 14 is rotatably connected to a first longitudinal end 9 of the handle 4, and a lever mechanism 16, which is rotatably mounted on the handle housing 8 via a rotation axis 21, wherein a second longitudinal end 20 of the handle 4 is movably attached to the handle housing 8 via the lever mechanism 16, wherein the lever element 10 is formed one-armed and angled, wherein the lever mechanism 16 has a handle lever 22 and a lever body 23 rotatably mounted on the rotation axis 21, wherein the handle lever 22 is formed one-armed and angled, wherein a first end 24 of the handle lever 22 is rotatably connected to the second longitudinal end 20 of the handle 4 and a second end 25 of the handle lever 22 is rotatably connected to the lever body 23 via a pivot point 26, wherein the lever element 10 is connected to the lever mechanism 16 motion-coupled in such a manner, that, with a movement of the handle 4 from the non-use position into the actuation position, the lever element 10 rotates about the lever rotation axis 12 and at the same time the lever mechanism 16 rotates about the rotation axis 21, and wherein the lever element 10 extends, at the onset of rotation about the lever rotation axis 12, the first longitudinal end 9 of the handle 4 from the outer contour 7 and the lever mechanism 16 extends, at the onset of rotation about the rotation axis 21, the second longitudinal end 20 of the handle 4 from the outer contour 7 only after exceeding a dead center 72 of the handle lever 22.

According to aspects of the further preferred embodiment, a motor-driven actuator 19 is mounted on the handle housing 8, which rotates the lever element 10 about the lever rotation axis 12 in a current-driven normal operation of the door handle assembly 3. The lever member 10 is motion-coupled with the lever mechanism 16 via a movement transfer bracket 17. Further, the lever body 23 has a support element 71, at which the handle lever 22 abuts at least partially in the non-use position of the handle 4 and with a movement of the handle 4 in the direction of the actuation position until exceeding a dead center 72.

According to further aspects of the further preferred embodiment, a first longitudinal end 39 of the movement transfer bracket 17 with a lever rotation axis distance 73 to the lever rotation axis 12 is rotatably connected to the lever element 10, and wherein a second longitudinal end 40 of the movement transfer bracket 17 with a rotation axis distance 74 to the rotation axis 21 is rotatably connected to the lever mechanism 16. The lever body 23 has a one-armed passive lever 27 and a two-armed active lever 28, wherein a first end 29 of the first passive lever 27 and the active lever 28 are mounted on the rotation axis 21 mounted on the handle housing 8, wherein a first end 24 of the handle lever 22 is rotatably connected to the second longitudinal end 20 of the handle 4, wherein a second end 25 of the handle lever 22 is rotatably connected to a second end 31 of the passive lever 27, wherein a first active lever arm 28*a* of the active lever 28 is rotatably connected to the second longitudinal end 40 of the movement transfer bracket 17 and the support element 71 is formed on a second active lever arm 28*b* of the active lever 28. The first end 29 of the passive lever 27 is non-rotatably connected to the rotary axis 21 and the first end 30 of the active lever 28 is rotatably connected to the rotary axis 21. The lever mechanism 16 has a holding element 33, wherein the passive lever 27 furthermore has a contact portion 34 and a counter contact portion 35 is formed on the active lever 28, and wherein the holding element 33 has a holding force pressing the contact portion 34 of the passive lever 27 against the counter contact portion 35 of the active lever 28.

According to still further aspects of the further preferred embodiment, the holding element 33 permits a movement of the passive lever 27 relative to the active lever 28 against the holding force exerted by the holding element 33, so that the contact portion 34 of the passive lever 27 is spaced from the counter contact portion 35 of the active lever 28. The holding element 33 is designed as an elastic spring element 36, wherein a first leg 36*a* of the spring element 36 engages a hook-shaped holding lug 37 and formed on the passive lever 27, and a second leg 36*b* of the spring element 36 engages a hook-shaped holding piece 38 and formed on the active lever 28. The lever element 10 is further formed U-shaped angled, wherein a handle lever leg 44 terminating at the first end 24 of the handle lever 22 is formed with a handle lever length 45, which is at least 1.25 times greater than a lever element length 46 of a lever element leg 47 terminating at the second lever end 14 of the lever element 10. Upon movement of the handle 4, the second lever end 14 of the lever element 10 is constantly spaced from the lever rotation axis 12, whereas the first end 24 of the handle lever 22 is arranged at a varying space from the rotation axis 21 as a function of the movement position of the handle 4.

In still other further aspects of the further preferred embodiment, the mechanical reset element 49 presses the handle 4 into its non-use position, and permits a movement of the handle 4 from the non-use position in the direction of the actuation position against a reset force generated by the mechanical reset element 49. The mechanical reset element 49 is formed as a reset spring 50, which is wound around the lever rotation axis 12, wherein a first spring leg 50*a* of the reset spring 50 is supported on the handle housing 8 and a second spring leg 50*b* of the reset spring 50 is supported on the lever element 10.

A further aspect of the further preferred embodiment provides a method for operating a door handle arrangement 3 of a vehicle door 2, wherein the door handle arrangement 3 has a handle housing 8 which can be attached to the vehicle door 2 and a handle 4 mounted on the handle housing 8, which, in a non-use position, is arranged proceeding flush with strake with an outer contour 7 of the vehicle door 2, and which, for actuation by an operator into an actuation position, in which the handle 4 protrudes from the outer contour 7 of the vehicle door and can be actuated by the operator for opening the vehicle door 2, is formed in a movable manner, wherein the handle 4 is connected movably to a handle housing 8 with a first longitudinal end 9 via a lever element 10, and wherein the handle 4 is connected movably to the handle housing 8 with a second longitudinal end 20 via a lever mechanism 16, wherein, upon a movement from the non-use position into the actuation position, the first longitudinal end 9 of the handle 4 is extended from the outer contour 7 of the vehicle door 2 by the lever element 10 and the second longitudinal end of the handle 4 is extended in a time-delayed manner to the first longitudinal end 9 of the handle 4 by the lever mechanism 16, wherein the second longitudinal end 20 of the handle 4 is extended further by the lever mechanism 16 than the first longitudinal end 9 of the handle 4.

Another preferred embodiment of the invention relates to a door handle assembly 3 for a vehicle door 2 having a handle housing 8 attachable to the vehicle door 2, a handle 4 mounted on the handle housing 8, which is disposed in a non-operative position in a straight line with an outer contour 7 of the vehicle door 2 and adapted to be actuated by an operator to an actuation position in which the handle 4 protrudes from the outer contour 7 of the vehicle door 2 and can be operated by the operator to open the vehicle door 2, being movably formed on a lever member 10 of which a first lever end 11 rotatably mounted on a mounted on the handle housing 8 lever rotation axis 12 and of which a second lever end 14 is rotatably connected to a first longitudinal 9 of the handle 4, and a motor-driven actuator 19 which rotates the lever member 10 about the lever rotation axis 12 and thereby the handle 4 is from the non-use position g is moved into the actuation position, wherein a lever mechanism 16 is rotatably mounted on a rotation axis 21 on the handle housing 8, and wherein a second longitudinal end 20 of the handle 4 is movably attached to the handle housing 8 via the lever mechanism 16.

According to aspects of the other preferred embodiment, a mechanical reset element 49 presses the handle 4 into its non-use position, wherein a movement of the handle 4 from the non-use position in the direction of the actuation position permits a reset force generated by the mechanical reset element 49. The mechanical reset element 49 is formed as a reset spring 50, which is wound around the lever rotation axis 12, wherein a first spring leg 50*a* of the reset spring 50 is supported on the handle housing 8 and a second spring leg 50*b* of the reset spring 50 is supported on the lever element 10. The lever member 10 is motion-coupled with the lever mechanism 16 via a movement transfer bracket 17. A first longitudinal end 39 of the movement transfer bracket 17 is rotatably connected to the lever element 10 at a distance from the lever rotation axis 12, wherein a second longitudinal end 40 of the movement transfer bracket 17 is rotatably connected to the rotation axis 21 with the lever mechanism 16 at a distance.

According to further aspects of the other preferred embodiment, the lever mechanism 16 comprises a passive lever 27, an active lever 28 and a handle lever 22, wherein a first end 29 of the first passive lever 27 and a first end 30 of the active lever 28 are mounted on the rotational axis 21 mounted on the handle housing 8, wherein a first end 24 of the handle lever 22 is rotatably connected to the second longitudinal end 20 of the handle 4, wherein a second end 25 of the handle lever 22 is rotatably connected to a second end 31 of the passive lever 27, and wherein a connecting web 32 projects radially from the first end 30 of the active lever, which is rotatably connected to the second longitudinal end 40 of the movement transfer bracket 17. The first end 29 of the passive lever 27 is non-rotatably connected to the rotary axis 21, wherein the first end 30 of the active lever 28 is rotatably connected to the rotary axis 21. The lever mechanism 16 has a holding element 33, wherein the passive lever 27 furthermore has a contact portion 34 and a counter contact portion 35 is formed on the active lever 28, and wherein the holding element 33 has a holding force pressing the contact portion 34 of the passive lever 27 against the counter contact portion 35 of the active lever 28. The holding element 33 permits a movement of the passive lever 27 relative to the active lever 28 against the holding force exerted by the holding element 33, so that the contact portion 34 of the passive lever 27 is arranged at a distance from the counter contact portion 35 of the active lever 28.

According to still further aspects of the other preferred embodiment, the holding element 33 is formed as an elastic spring element 36, wherein a first leg 36*a* of the spring element 36 engages a hook-shaped holding lug 37 and formed on the passive lever 27 and a second leg 36*b* of the spring element 36 engages a holding piece 28 formed hook-shaped and at the active lever 28. The spring element 36 is arranged wound around the rotation axis 21. In the actuation position of the handle 4, the motor-driven actuator 19 presses the second longitudinal end 40 of the movement transfer lever 17 at least in sections portions against a locking stop 67 attached to the handle housing 8. Furthermore, in the actuation position of the handle 4, the motor-driven actuator 19 presses a support lug 68 formed on the lever element 10, at least in sections, against a support stop 69 formed on the grip housing 8.

Yet another preferred embodiment of the invention relates to a door handle assembly 3 for a vehicle door 2 with a handle housing 8 attachable to the vehicle door 2, a handle 4 mounted on the handle housing 8, which, in a non-use position is arranged proceeding flush with strake with an outer contour 7 of the vehicle door 2 and which, for actuation by an operator into the actuation position, in which the handle 4 protrudes from the outer contour 7 of the vehicle door 2, is formed in a movable manner, a lever element 10, of which a first lever end 11 is rotatably attached on a lever rotation axis 12 mounted on the handle housing, and of which a second lever end is motion-coupled with a first longitudinal end 9 of the handle 4, a motor-driven actuator 19, which, in a normal operation of the door handle assembly 3, rotates the lever element 10 about the lever rotation axis 12 and thereby moves the handle 4 from the non-use position into the actuation position, and a lever mechanism 16, which movably mounts a second longitudinal end 20 of the handle 4 on the handle housing 8, wherein the first longitudinal end 9 of the handle 4 is rotatably mounted on the second lever end 14 of the lever element 10, wherein, in an emergency operation of the door handle assembly 3 during a failure of the motor-driven actuator 19, the handle 4 can be moved by the operator into an emergency handling position, in which, with respect to the non-use position, the first longitudinal end 9 of the handle 4 is moved toward the handle housing 8 and the second longitudinal end 20 of the handle 4 is moved away from the handle housing 8, and wherein the lever mechanism 16 has a holding element 33, which permits a movement of the first longitudinal end 9 of the handle 4 in the direction of the handle housing 8 and relative to the second lever end 14 of the lever element 10 and a movement of the second longitudinal end 20 of the handle 4 directed away from the handle housing 8 against a holding force exerted by the holding element 33.

According to aspects of the still other preferred embodiment, the lever mechanism 16 comprises a passive lever 27, an active lever 28 coupled with the motor-drive actuator 19 and a handle lever 22, wherein a first end 29 of the first passive lever 27 and a first end 30 of the active lever 28 are mounted on the rotation axis 21 mounted on the handle housing 8, wherein a first end 24 of the handle lever 22 is rotatably connected to the second longitudinal end 20 of the handle 4 and a second end 25 of the handle lever 22 is rotatably connected to a second end 31 of the passive lever 27. The first end 29 of the passive lever 27 is non-rotatably connected to the rotary axis 21 and the first end 30 of the active lever 28 is rotatably connected to the rotary axis 21. The passive lever 27 has a contact portion 34, wherein a counter contact portion 35 is formed on the active lever 28, wherein, in the non-use position of the handle 4, the holding element 33 presses the contact portion 34 of the passive lever 27 against the counter contact portion 35 of the active lever 28.

According to further aspects of the yet other preferred embodiment, in the emergency handling position of the handle 4, a pressing force exerted by an operator and exceeding the holding force of the holding element 33 acts on the first longitudinal end 9 of the handle 4, wherein the contact portion 34 of the passive lever 27 is arranged turned away from the counter contact portion 35 of the active lever 28. In a movement from the non-use position to the emergency handling position, the handle 4 transmits a pressing force exerted by the operator on the first longitudinal element 9 to the passive lever 27 of the lever mechanism 16 via the second longitudinal member 20, which effects a relative rotation of the passive lever 27 to the active lever 28, so that, in the emergency handling position, the contact portion 34 of the passive lever 27 is arranged spaced from the counter contact portion 35 of the passive lever 27. The holding force of the holding element 33 is dimensioned such that the holding element 33 pushes the contact portion 34 of the passive lever 27 against the contact portion 35 of the active lever 28 up to an acceleration force acting in the event of a vehicle accident or up to a pressure force of at least 30 g exerted by the operator. The holding element 33 is further designed as an elastic spring element 36, wherein a first leg 36*a* of the spring element 36 engages a hook-shaped holding lug 37 and formed on the passive lever 27, and a second leg 36*b* of the spring element 36 engages a hook-shaped holding piece 38 and formed on the active lever 28.

According to still further aspects of yet another preferred embodiment, the elastic spring element 36 is wound around the rotation axis 21. The lever element 10 has a support lug 82 between its first lever end 11 and its second lever end 14, which, in the emergency handling position abuts a movement limiting lug 83 formed on the handle 4 and limiting the movement of the handle 4 in the direction of the handle housing 8.

Another further preferred embodiment of the invention relates to a door handle assembly 3 for a vehicle door 2 having a handle housing 8 attachable to the vehicle door 2, a handle 4 mounted on the handle housing 8, which, in a non-use position, is arranged flush with strake with an outer contour 7 of the vehicle door 2, and which, through actuation by an operator in a actuation position, in which the handle 4 protrudes with respect to the outer contour 7 of the vehicle door 2, is movably formed, and a vehicle door opening lever 18 mounted on the handle housing 8 between a standby position and an unlocking position opening the vehicle door 2, wherein the handle 4 is movably mounted by the operator from the actuation position to an emergency operation position for manual vehicle door opening, wherein the handle 4 is decoupled from the vehicle door opening lever 18 in its non-use position, and wherein the handle 4, with a movement from the actuation position into the emergency actuation position, couples with the vehicle door opening lever 18 and moves this into the unlocking position.

According to further aspects of the other further preferred embodiment, the lever mechanism 16 mounts the handle 4 rotatably on the handle housing 8, wherein the handle 4, with a movement from the actuation position into the emergency actuation position, couples with the vehicle door opening lever 18. The lever element 10 mounted on the handle housing 8 is connected to a first longitudinal end 9 of the handle 4, wherein the lever mechanism 16 has a passive lever 27, of which a first end 29 is non-rotatably connected to a rotation axis 21 rotatably mounted on the handle housing 8 and of which a second end 31 is connected to a second longitudinal end 20 of the handle 4. The passive lever 27 has at its first end 29 a radially extending actuation projection 75, wherein a hook-shaped cam portion 76 is formed on the vehicle door opening lever 76, and wherein upon movement of the handle 4 from the actuation position in the direction of the emergency actuation position, the actuation lug engages the cam portion 76 and pushes the vehicle door opening lever 18 from the standby position penetrates into the unlocking position.

According to still further aspects of the other further preferred embodiment, a counterforce element 78 is formed on a portion of the actuation lug 75 which permits movement of the handle 4 from the actuation position into the emergency actuation position against a counterforce exerted by the counterforce element 78. Further, the counterforce element 78 is formed as an elastic leg spring element 79, wherein a first leg 79*a* of the leg spring element 79 is supported on the actuation lug 75 and a second leg 79*b* of the leg spring element 79 abuts a hook-shaped holding lug 80. The second leg 79*b* of the leg spring member 79, with a movement of the handle 4 out of the actuation position in the direction of the emergency actuation position, comes into abutment with a limit stop 81 formed on the handle housing 8, wherein the leg spring element 79 in the emergency actuation position of the handle 4 is compressed generating the counterforce.

The invention described above is of course not limited to the described and illustrated embodiment. It is obvious that numerous variations, which are obvious to a person skilled in the art according to the intended application, can be made to the embodiment shown in the figure, without departing from the scope of the invention. The invention includes everything that is contained in the description and/or is illustrated in the drawing, including that which is obvious to the person skilled in the art, which deviates from the specific exemplary embodiment.

The invention claimed is:

1. A door handle assembly for a vehicle door with a handle configured to be flush with an outer contour of the vehicle door in a non-use position for actuation by an operator, the door handle assembly comprising:

a handle housing that can be attached to the vehicle door-, a lever element mounting the handle on the handle housing, of which a first lever end is rotatably mounted on a lever rotation axis mounted on the handle housing and of which a second lever end is motion-coupled to the handle, and a motor-driven actuator that is motion-coupled to the lever element, which is rotatably mounted on the handle housing via a motor drive shaft between a rest position into a door opening position via a handle extension position, which is a rotary movement about the motor drive shaft, wherein the motor-driven actuator is disk-shaped with a non-uniform edge which cooperates with a lever lug, by the rotary movement of the motor-driven actuator about the motor drive shaft from the rest position into the handle extension position, with the lever lug formed on the lever element, wherein the non-uniform edge has a first edge portion with a radius increasing from a minimum radius to a maximum radius and a second edge portion with the maximum radius, wherein the maximum radius is formed larger than the minimum radius, wherein, with a uniform handle extension movement of the motor-driven actuator from the rest position into the handle extension position, the first edge portion presses against the lever lug of the lever element with an increasing radius and moves the handle from the non-use position into the actuation position via the lever element, wherein, in a normal operation of the door handle assembly, the motor-driven actuator during its movement from the rest position, in which the handle is arranged in the non-use position, to the handle extension position, moves the handle into an actuation position, in which the handle protrudes from the outer contour of the vehicle door, wherein the handle is formed to be movable from the actuating position into a servo opening position by means of actuation by an operator, wherein a detection means is arranged on the handle housing, which, with detection of a movement of the handle from the actuation position into the servo opening position, is arranged effecting a movement of the motor-driven actuator from the handle extension position to the door opening position, wherein the motor-driven actuator is motion-coupled to the lever element mounted movably on the handle housing between a standby position and an unlocking position, and wherein the motor-driven actuator in its movement from the handle extension position into the door opening position moves the lever element from the standby position into the unlocking position, in which the vehicle door can be opened.

2. The door handle assembly according to claim 1, wherein the uniform handle extension movement of the motor-driven actuator stops when the second edge portion of the motor-driven actuator abuts the lever lug of the lever element.

3. The door handle assembly according to claim 1, wherein the non-uniform edge has a third edge portion with the minimum radius, wherein a transition from the second edge portion to the third edge portion is formed abruptly.

4. The door handle assembly according to claim 3, wherein the lever lug of the lever element abuts the third edge portion when the handle is arranged in the non-use position and the motor-driven actuator is arranged in the rest position.

5. The door handle assembly according to claim 1, wherein an unlocking contour is formed on an upper side or a bottom side of the disk-shaped and motor-driven actuator, which cooperates with the lever element during the movement of the motor-driven actuator from the handle extension position into the door opening position.

6. The door handle assembly according to claim 5, wherein the unlocking contour has a first contour portion with a neutral radius, a second contour portion with a progression radius and a third contour portion with a constant radius, wherein the constant radius is greater than the neutral radius, wherein the constant radius and the neutral radius each have a radius that is constant, and wherein the progression radius is a radius increasing from the neutral radius to the constant radius.

7. The door handle assembly according to claim 6, wherein, during the rotary movement of the motor-driven actuator from the rest position into the handle extension position, the first contour portion with the neutral radius moves tangentially past a longitudinal end of the lever element.

8. The door handle assembly according to claim 7, wherein during a door unlocking rotary movement of the motor-driven actuator from the handle extension position into the door opening position, the second contour portion and then the third contour portion of the unlocking contour presses against the longitudinal end of the lever element and pushes the lever element from its standby position into its unlocking position for opening the vehicle door.

9. The door handle assembly according to claim 8, wherein the door unlocking rotary movement stops when the second edge portion of the motor-driven actuator abuts the lever lug of the lever element.

10. The door handle assembly according to claim 6, wherein the constant radius of the unlocking contour is smaller than the maximum radius of the non-uniform edge of the motor-driven actuator.

11. The door handle assembly according to claim 1, wherein a cam disc is rotatably mounted on the handle housing in addition to and separately from the motor-driven actuator via the motor drive shaft, wherein the cam disk cooperates with the lever element, in order to move the lever element from the standby position into the unlocking position.

* * * * *